US011287200B1

(12) United States Patent
Oglesby

(10) Patent No.: US 11,287,200 B1
(45) Date of Patent: Mar. 29, 2022

(54) GAS BLOCK SYSTEM

(71) Applicant: Paul A. Oglesby, Darley (GB)

(72) Inventor: Paul A. Oglesby, Darley (GB)

( * ) Notice: Subject to any disclaimer, the term of this patent is extended or adjusted under 35 U.S.C. 154(b) by 142 days.

(21) Appl. No.: 16/698,443

(22) Filed: Nov. 27, 2019

Related U.S. Application Data

(60) Provisional application No. 62/772,352, filed on Nov. 28, 2018.

(51) Int. Cl.
*F41A 5/28* (2006.01)

(52) U.S. Cl.
CPC ..... *F41A 5/28* (2013.01)

(58) Field of Classification Search
CPC ..... F41A 5/28; F41A 5/26; F41A 5/18; F41A 5/32; F41A 5/36
See application file for complete search history.

(56) References Cited

U.S. PATENT DOCUMENTS

2011/0179945 A1* 7/2011 Clark ..... F41A 5/18 89/193
2020/0025498 A1* 1/2020 Wheeler ..... F41A 5/26
2020/0033085 A1* 1/2020 Robinson ..... F41A 5/28
2020/0278165 A1* 9/2020 Wheeler ..... F41A 21/28

* cited by examiner

*Primary Examiner* — J. Woodrow Eldred
(74) *Attorney, Agent, or Firm* — Shaddock Law Group, PC

(57) ABSTRACT

A gas block system including at least some of a firearm barrel having a barrel conical shoulder, wherein a threaded gas block attachment area is formed proximate a gas block attachment area of the barrel, and wherein a barrel gas port is formed within at least a portion of the gas block attachment area of the barrel; a gas block having a gas block barrel borehole with a tapered proximal shoulder and a tapered distal shoulder, the gas block having a gas block gas port; and a gas block nut having a threaded gas block nut aperture portion and a tapered extension portion extending from the gas block nut, wherein the gas block nut is configured to secure the gas block to the barrel such that the tapered proximal shoulder is abutted against the barrel conical shoulder and the tapered distal shoulder is abutted against the tapered extension portion.

20 Claims, 23 Drawing Sheets

GAS BLOCK SYSTEM

CROSS-REFERENCE TO RELATED APPLICATIONS

This patent application claims the benefit of U.S. Patent Application Ser. No. 62/772,352, filed Nov. 28, 2018, the disclosure of which is incorporated herein by reference in its entirety.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE INVENTION

1. Field of the Invention

The present disclosure relates generally to the field of firearms. More specifically, the present disclosure relates to a gas block system for a firearm.

2. Description of Related Art

A number of firearms operate based on a gas blowback system. One such firearm is the M-16, M-4, and AR-15 family of firearms.

The AR-15 is based on the AR-10, which was designed by Eugene Stoner, Robert Fremont, and L. James Sullivan of the Fairchild ArmaLite Corporation in 1957. Today, there are numerous variants of the AR-15 that are manufactured by a number of companies. The AR-15 and its various related derivative platforms are used by civilians, law enforcement personnel, and military forces around the world.

During normal operation of a semiautomatic AR-15 style rifle, when a round is fired, gas from the burning propellant forces the bullet through the barrel. Before the bullet leaves the barrel, a portion of the gas enters a gas port in the upper part of the barrel under the front sight (or gas block). The gas port directs gas through a portion of the front sight (or gas block) and into the gas tube, which directs the gas into a cylinder between the bolt carrier and the bolt and drives the bolt carrier rearward.

The buffer, which is pushing on the rear of the bolt carrier group, is forced rearward by the bolt carrier group compressing the recoil spring. During this rearward movement, a cam track in the upper portion of the bolt carrier acts on the bolt cam pin, rotating the cam pin and bolt clockwise so that the bolt locking lugs are unlocked from the barrel extension locking lugs. As the rearward movement of the bolt carrier group continues, the empty cartridge case is extracted from the chamber, and ejected through the ejection port.

As the bolt carrier group clears the top of an inserted magazine and the empty cartridge case is expelled, a new round is pushed into the path of the bolt by the upward thrust of the magazine follower and spring.

As the bolt carrier group continues to move rearward, it overrides the hammer and forces the hammer down into the receiver, compressing the hammer spring, and allowing the rear hook of the hammer to engage with the hammer disconnect.

When the bolt carrier group reaches its rearmost position (when the rear of the buffer contacts the rear of the buffer tube), the compressed recoil spring expands, driving the buffer assembly forward with enough force to drive the bolt carrier group forward, toward the chamber, initiating chambering of the waiting round from the magazine into the chamber.

The forward movement of the bolt ceases when the locking lugs pass between the barrel extension locking lugs and the round is fully chambered. When the bolt carrier enters the final portion of its forward movement, the bolt cam pin emerges from the cam pin guide channel in the upper receiver and moves along the cam track, rotating the bolt counterclockwise. This rotation locks the bolt to the barrel extension (by interaction of the bolt locking lugs and the barrel extension locking lugs). The locking of the bolt completes the cycle of operation and, when the trigger is released, the rear hammer hook hammer slips from the disconnect and the front hammer hook is caught by the sear of the trigger. The firearm is then ready to be fired again.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE INVENTION

Unfortunately, typical gas blocks and gas systems are not capable of bleeding off extra gas pressure before the propellant gas pressure actuates the bolt carrier and causes excessive recoil.

The disadvantages and shortcomings of the prior art are overcome by the features and elements of the gas block system of the present disclosure. The present disclosure features a gas block that is retained by a nut on a threaded barrel. A gas seal conical shoulder on both the barrel and the gas block retaining nut. In turn the gas block has a female cut that slides onto the barrel shoulder and is then clamped by the nut and its secondary seal. This means that the area under the gas block is now very effectively sealed and gas cannot escape. The best block is also positioned concentric to the outer diameter of the barrel rather than being clamped down onto the top surface of the barrel. This helps harmonics of the barrel when fired.

Because the gas block is now sealed, it is possible to create a labyrinth under its diameter by removing barrel material. The labyrinth may be an expansion chamber or a series of channels that causes the gas to have to flow further than normal from the port in the barrel to the port in the block.

In this way, a longer gas system may be utilized on an over barrel suppressor setup. Normally the over barrel suppressor would dictate have far forward the gas port hole could be positioned.

The angle of the gas port hole be formed at an angle to present a shallower angle of the port to the blast gas and reduces gas port erosion. It also allows the port to be positioned further forward in the barrel in relation to the gas block itself.

In addition, an olive or ferrule is also used with a tightening nut to form an effective seal on the gas tube/gas block interface area. The tube is still held in position by the roll pin, however gas cannot leak along the tube and vent out of the rear of the gas block any longer.

Also, the gas tube is held in place with a traditional roll pin for safety however, a threaded tube connector nut compresses the olive or ferrule to further seal the tube to the block.

The advantages of the present disclosure are optionally attained by providing, in an exemplary, nonlimiting embodiment, a gas block system that includes at least some of a firearm barrel having a barrel projection and a barrel conical shoulder, wherein a threaded gas block attachment area is formed proximate a gas block attachment area of the barrel, and wherein a barrel gas port is formed within at least a portion of the gas block attachment area of the barrel; a gas block having a gas block barrel borehole, the gas block barrel borehole having a tapered proximal shoulder and a tapered distal shoulder, the gas block having a gas block gas port; and a gas block nut having a threaded gas block nut aperture portion and a tapered extension portion extending from the gas block nut, wherein the gas block nut is configured to secure the gas block to the barrel such that the tapered proximal shoulder is abutted against the barrel conical shoulder and the tapered distal shoulder is abutted against the tapered extension portion.

In certain exemplary, nonlimiting embodiments of the present disclosure, the barrel gas port is formed at a 45° angle relative to a longitudinal axis of the firearm barrel.

In certain exemplary, nonlimiting embodiments of the present disclosure, the gas block gas port is formed at a 45° angle relative to a longitudinal axis of the gas block barrel borehole of the gas block.

In certain exemplary, nonlimiting embodiments of the present disclosure, the gas block nut is configured to secure the gas block to the barrel by interaction between the threaded gas block attachment area of the barrel and the threaded gas block nut aperture portion of the gas block nut.

In certain exemplary, nonlimiting embodiments of the present disclosure, at least a portion of the gas block attachment area of the barrel comprises a gas expansion recess.

In certain exemplary, nonlimiting embodiments of the present disclosure, the gas expansion recess comprises a grooved portion, a spiral groove, or a reduced diameter portion of the barrel.

In certain exemplary, nonlimiting embodiments of the present disclosure, the gas expansion recess provides fluid communication between the barrel gas port and the gas block gas port.

In certain exemplary, nonlimiting embodiments of the present disclosure, the gas block nut is configured to secure the gas block to the barrel such that the barrel borehole is in fluid communication with the gas block gas port.

In certain exemplary, nonlimiting embodiments of the present disclosure, a barrel projection notch is formed in a portion of the barrel projection so as to interact with at least a portion of an extension alignment protrusion of the gas block such that if the gas block is installed on the barrel, alignment of at least a portion of the extension alignment protrusion within at least a portion of the barrel projection notch helps to maintain the gas block in a desired rotational position relative to the barrel.

In certain exemplary, nonlimiting embodiments of the present disclosure, a gas tube borehole extends into at least a portion of the gas block extension portion, the gas tube borehole having an internally threaded portion, wherein a compression nut is adapted to be at least partially threadedly attached or coupled within at least a portion of the gas tube borehole, via interaction of a compression nut threaded portion of the compression nut and the internally threaded portion of the gas tube borehole to at least partially secure a gas tube within at least a portion of the gas tube borehole.

In certain exemplary, nonlimiting embodiments of the present disclosure, a compression fitting is positioned around at least a portion of the gas tube and is maintained within the gas tube borehole by the compression nut.

In certain exemplary, nonlimiting embodiment, the gas block system of the present disclosure includes at least some of a firearm barrel having a barrel projection and a barrel conical shoulder, wherein a threaded gas block attachment area is formed proximate a gas block attachment area of the barrel, and wherein a barrel gas port is formed within at least a portion of the gas block attachment area of the barrel; a gas block having a gas block barrel borehole, the gas block barrel borehole having a tapered proximal shoulder and a tapered distal shoulder, the gas block having a gas block gas port, wherein a gas tube borehole extends into at least a portion of the gas block extension portion, the gas tube borehole having an internally threaded portion, wherein a compression nut is adapted to be at least partially threadedly attached or coupled within at least a portion of the gas tube borehole, via interaction of a compression nut threaded portion of the compression nut and the internally threaded portion of the gas tube borehole to at least partially secure a gas tube within at least a portion of the gas tube borehole; and a gas block nut having a threaded gas block nut aperture portion and a tapered extension portion extending from the gas block nut, wherein the gas block nut is configured to secure the gas block to the barrel such that the tapered proximal shoulder is abutted against the barrel conical shoulder and the tapered distal shoulder is abutted against the tapered extension portion.

In certain exemplary, nonlimiting embodiment, the gas block system of the present disclosure includes at least some of a gas block having a gas block barrel borehole, the gas block having a gas block gas port, wherein a gas tube borehole extends into at least a portion of the gas block extension portion, the gas tube borehole having an internally threaded portion, wherein a compression nut is adapted to be at least partially threadedly attached or coupled within at least a portion of the gas tube borehole, via interaction of a compression nut threaded portion of the compression nut and the internally threaded portion of the gas tube borehole to at least partially secure a gas tube within at least a portion of the gas tube borehole.

Accordingly, the presently disclosed systems, methods, and/or apparatuses provide a gas block system that allows for adjustment of the amount of propellant gas that is returned to the firearm for cycling the bolt during a firing cycle.

The presently disclosed systems, methods, and/or apparatuses optionally and separately provide a gas block that is retained by a nut on a partially threaded barrel.

The presently disclosed systems, methods, and/or apparatuses optionally and separately provide a gas block system that provides an improved fluid seal between the gas block and the barrel.

The presently disclosed systems, methods, and/or apparatuses optionally and separately provide a gas block system that may optionally provide increased bolt lock time.

The presently disclosed systems, methods, and/or apparatuses optionally and separately provide a gas block system that reduces felt recoil.

The presently disclosed systems, methods, and/or apparatuses optionally and separately provide a gas block system that allows the gas system to be "tuned".

The presently disclosed systems, methods, and/or apparatuses optionally and separately provide a gas block system that reduces felt recoil and provides balance to the gas system.

These and other aspects, features, and advantages of the present disclosure are described in or are apparent from the following detailed description of the exemplary, non-limiting embodiments of the present disclosure and the accompanying figures. Other aspects and features of embodiments of the present disclosure will become apparent to those of ordinary skill in the art upon reviewing the following description of specific, exemplary embodiments of the present disclosure in concert with the figures. While features of the present disclosure may be discussed relative to certain embodiments and figures, all embodiments of the present disclosure can include one or more of the features discussed herein. Further, while one or more embodiments may be discussed as having certain advantageous features, one or more of such features may also be used with the various embodiments of the systems, methods, and/or apparatuses discussed herein. In similar fashion, while exemplary embodiments may be discussed below as device, system, or method embodiments, it is to be understood that such exemplary embodiments can be implemented in various devices, systems, and methods of the present disclosure.

Any benefits, advantages, or solutions to problems that are described herein with regard to specific embodiments are not intended to be construed as a critical, required, or essential feature(s) or element(s) of the present disclosure or the claims.

BRIEF DESCRIPTION OF THE SEVERAL VIEWS OF THE DRAWINGS

As required, detailed exemplary embodiments of the present disclosure are disclosed herein; however, it is to be understood that the disclosed embodiments are merely exemplary of the systems, methods, and/or apparatuses that may be embodied in various and alternative forms, within the scope of the present disclosure. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present disclosure.

The exemplary embodiments of the presently disclosed systems, methods, and/or apparatuses will be described in detail, with reference to the following figures, wherein like reference numerals refer to like parts throughout the several views, and wherein.

DETAILED DESCRIPTION OF THE INVENTION

Figure 1:
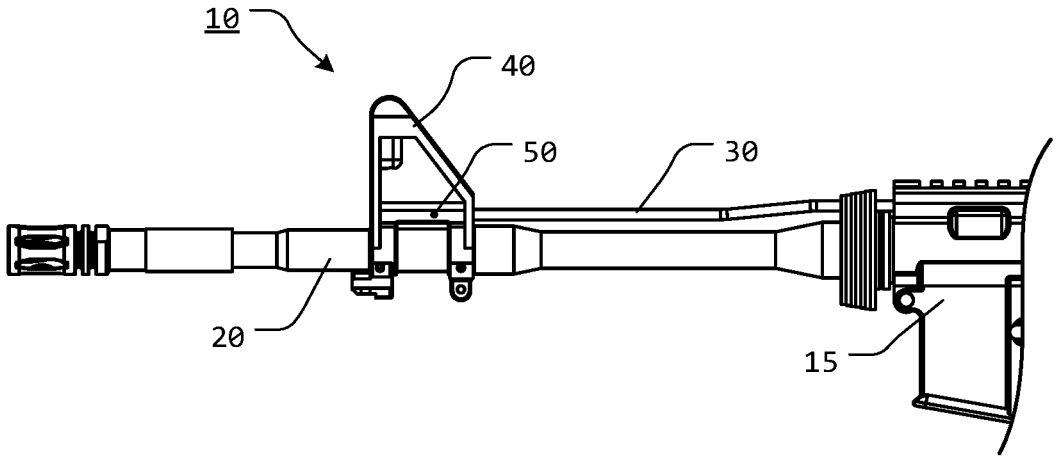
FIG. 1 PRIOR ART
FIG. 1 illustrates a side view of a portion of a known AR-15 style barrel assembly, showing a known front sight (or gas block)

For simplicity and clarification, the design factors and operating principles of the gas block system and/or muzzle device system according to certain aspects of the presently disclosed systems, methods, and/or apparatuses are explained with reference to various exemplary embodiments of a gas block system and/or muzzle device system according to certain aspects of the presently disclosed systems, methods, and/or apparatuses. The basic explanation of the design factors and operating principles of the gas block system and/or muzzle device system is applicable for the understanding, design, and operation of the gas block system and/or muzzle device system of the presently disclosed systems, methods, and/or apparatuses. It should be appreciated that the gas block system and/or muzzle device system can be adapted to many applications where excessive gas pressure or blowback is experienced within a firearm.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the elements such terms describe. Thus, these terms are not necessarily intended to indicate temporal or other prioritization of such elements.

The term "coupled", as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that the terms "AR-15", "firearm", and "gas block" are used for basic explanation and understanding of the operation of the systems, methods, and apparatuses of the present disclosure. Therefore, the terms "AR-15", "firearm", and "gas block" are not to be construed as limiting the systems, methods, and apparatuses of the present disclosure. Thus, the terms "AR-15" and "firearm" are to be understood to broadly include any firearm having a blowback operated system.

For simplicity and clarification, the compression screw attachment system of the present disclosure will be described as being used in connection with a safety selector lever for an AR-15 or M4 style firearm. However, it should be appreciated that these are merely exemplary embodiments of the compression screw attachment system and are not to be construed as limiting the present disclosure. Thus, the compression screw attachment system of the present disclosure may be utilized in connection with any firearm or other device and may be utilized to attach or couple elements together.

Figure 2:
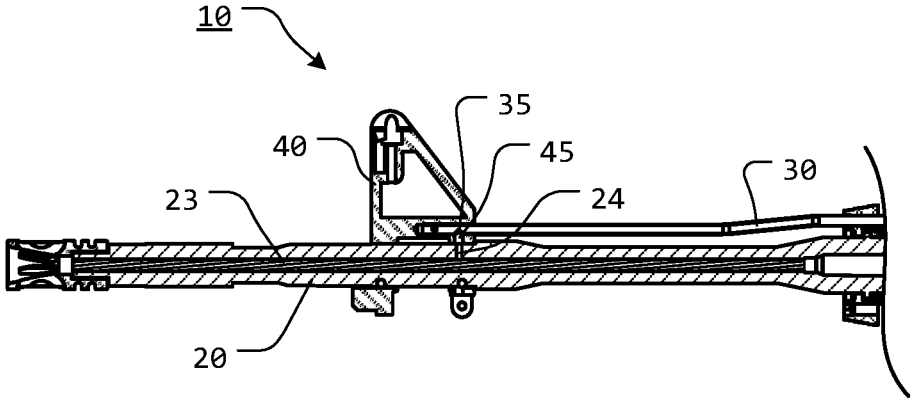
FIG. 2 PRIOR ART
FIG. 2 illustrates a side cutaway view of a portion of a known AR-15 style barrel assembly, showing a known front sight (or gas block)

In the form of the present disclosure chosen for purposes of illustration, FIGS. 1 and 2 illustrate certain elements and/or aspects of a known, exemplary AR-15 style barrel assembly 10, showing a known front sight gas block 40.

Generally, the barrel assembly 10 includes a barrel 20 extending from an upper receiver 15. The barrel 20 includes a borehole 23 and a barrel gas port 24. A front sight gas block 40 is fitted to the barrel 20 such that a front sight gas port 45 is aligned with the barrel gas port 24 and a gas tube gas port 35, such that the borehole 23 is in fluid communication (via barrel gas port 24, front sight gas port 45, and gas tube gas port 35) with the gas tube 30. The gas tube 30 is maintained in place relative to the front sight gas port 45, via a roll pin 50. In this manner, the barrel assembly 10 is able to operate, as described above.

It should be appreciated that a more detailed explanation of the components of the barrel assembly 10, instructions regarding how to attach and use the various components of the barrel assembly 10, methods for installing the related components of the barrel assembly 10, and certain other items and/or techniques necessary for the implementation and/or operation of the various components of the AR-15 platform are not provided herein because such components are commercially available and/or such background information will be known to one of ordinary skill in the art. Therefore, it is believed that the level of description provided herein is sufficient to enable one of ordinary skill in the art to understand and practice the systems, methods, and/or apparatuses as described.

Figure 3:
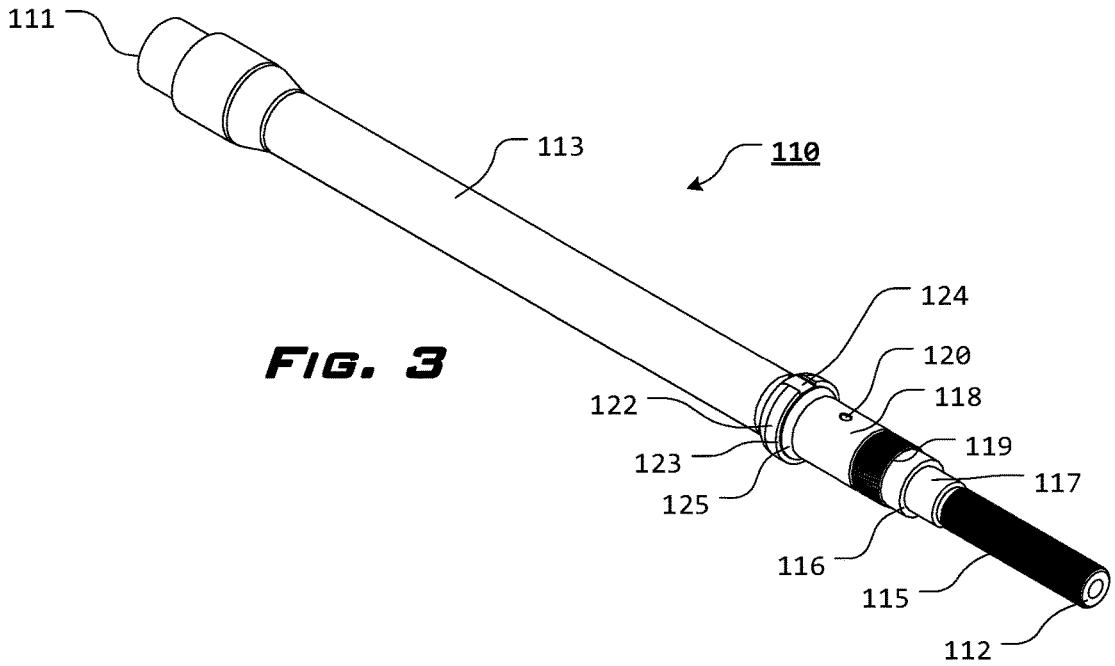
FIG. 3 illustrates an upper, front, perspective view of an exemplary embodiment of a barrel, according to certain aspects of the presently disclosed systems, methods, and/or apparatuses.
Figure 55:
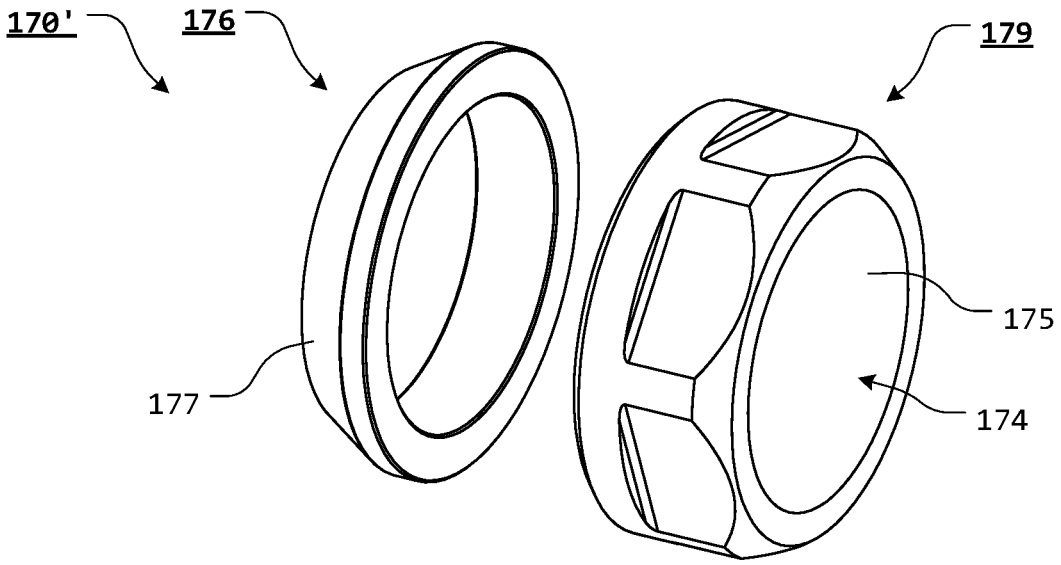
FIG. 55 illustrates a front, perspective view of certain exemplary components of an exemplary gas block nut assembly, according to certain aspects of the presently disclosed systems, methods, and/or apparatuses.

FIGS. 3-55 illustrate certain elements and/or aspects of various exemplary embodiments of a gas block system 100, according to this invention. In certain illustrative, non-limiting embodiments of the present disclosure, as illustrated in FIGS. 3-55, the gas block system 100 comprises at least some of a barrel 110, a gas block 150, a gas block nut 170, and optional compression nut 180, and an optional compression fitting 187.

Figure 4:
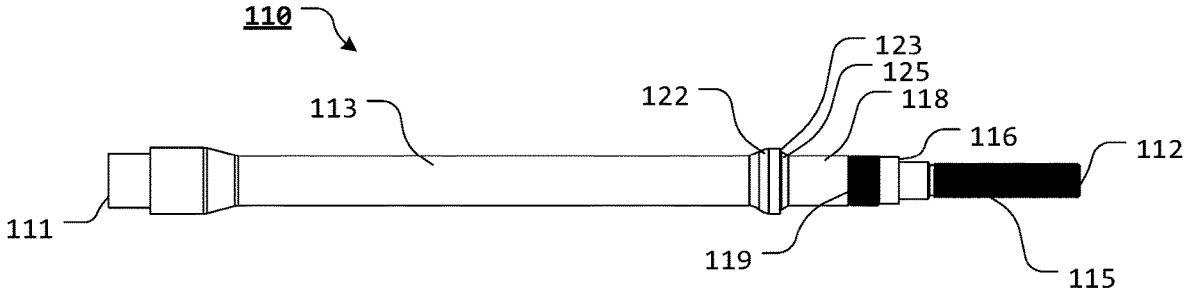
FIG. 4 illustrates a left side view of an exemplary embodiment of a barrel, according to certain aspects of the presently disclosed systems, methods, and/or apparatuses.
Figure 5:
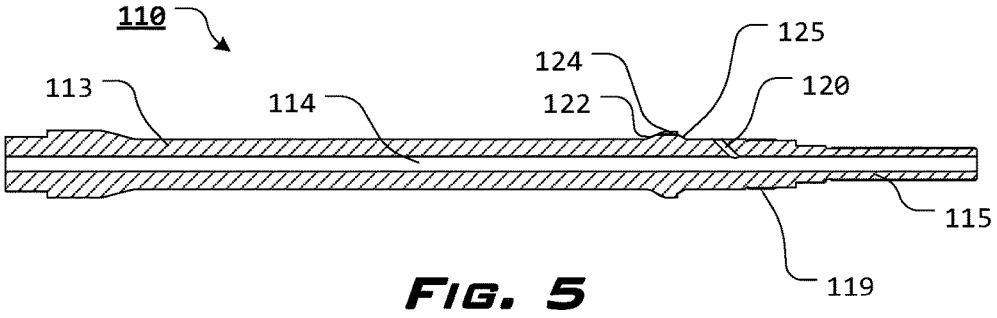
FIG. 5 illustrates a left side, cross-sectional view of an exemplary embodiment of a barrel, according to certain aspects of the presently disclosed systems, methods, and/or apparatuses.
Figure 6:
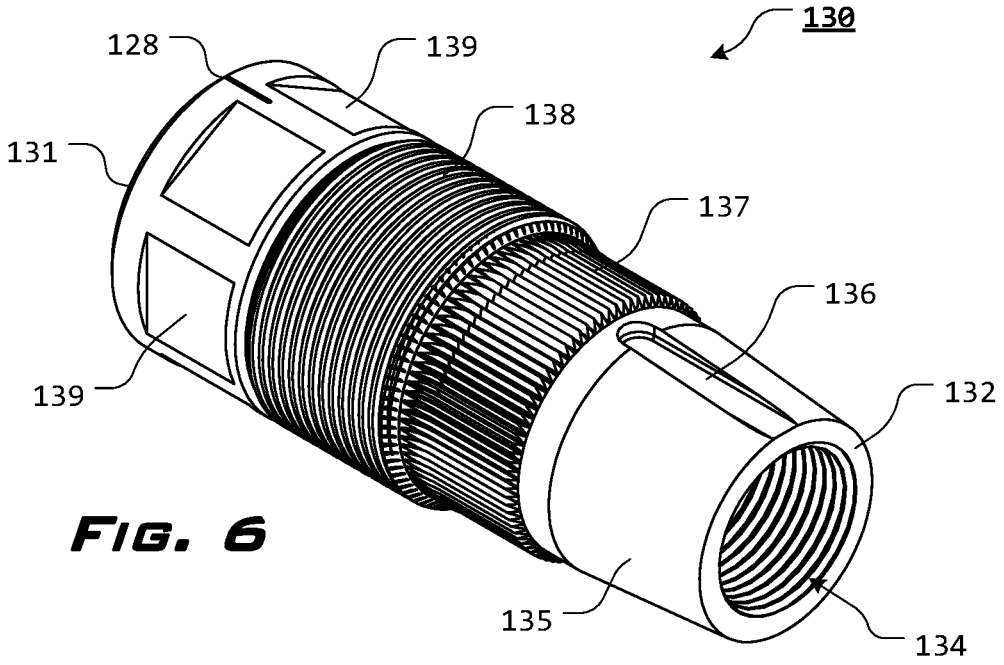
FIG. 6 illustrates an upper, front, perspective view of an exemplary embodiment of a muzzle adapter, according to certain aspects of the presently disclosed systems, methods, and/or apparatuses.
Figure 7:
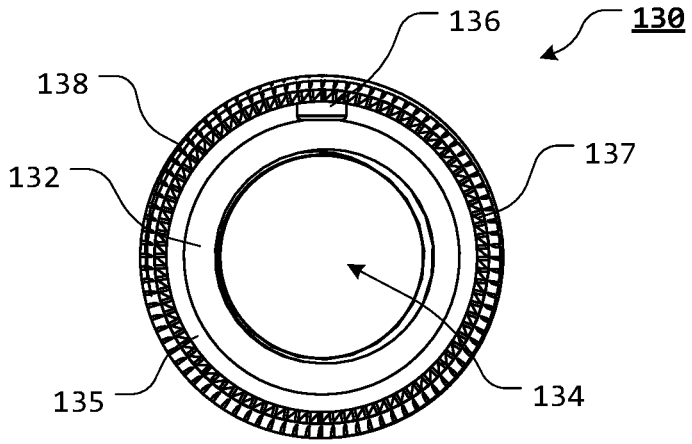
FIG. 7 illustrates a front view of an exemplary embodiment of a muzzle adapter, according to certain aspects of the presently disclosed systems, methods, and/or apparatuses.
Figure 8:
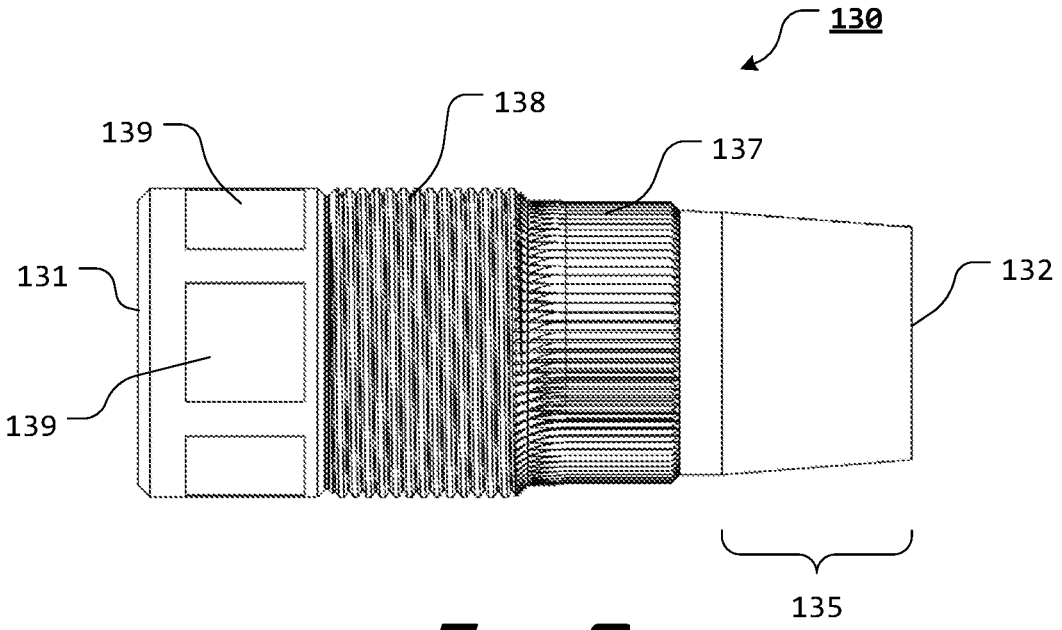
FIG. 8 illustrates a right side view of an exemplary embodiment of a muzzle adapter, according to certain aspects of the presently disclosed systems, methods, and/or apparatuses.

As illustrated most clearly in FIGS. 3-5, the barrel 110 comprises an elongate barrel 110 having a barrel body 113 and extending, along a longitudinal axis, $A_L$, from a barrel chamber end 111 to a barrel muzzle end 112. A barrel borehole 114 is formed through the barrel body 113, along the longitudinal axis. It should be appreciated that the barrel 110 may be a rifle barrel, a pistol barrel, or any other small or large caliber operable, toy, or replica firearm, artillery, or other barrel.

The barrel 110 includes a threaded muzzle device attachment area 115 having muzzle threads that extend, within a threaded muzzle device attachment area 115, from the barrel muzzle end 112 of the barrel 110, toward the barrel chamber end 111 of the barrel 110. In various exemplary embodiments, the muzzle threads within the threaded muzzle device attachment area 115 are similar to known muzzle threads included on a standard barrel. However, the threaded muzzle device attachment area 115 may extend further along the barrel muzzle end 112 of barrel 110 than known muzzle threads on a standard barrel.

In certain exemplary embodiments, the muzzle threads within the threaded muzzle device attachment area 115 extend to a reduced diameter portion 117 of the barrel body 113. The reduced diameter portion 117 of the barrel body 113 extends to a muzzle device shoulder 116. The muzzle device shoulder 116 extends between a reduced diameter portion 117 of the barrel body 113 and a subsequent portion of the barrel body 113.

It should be appreciated that in certain exemplary embodiments, the barrel muzzle end 112 portion of the barrel 110 is formed substantially similarly to a known barrel muzzle end 112 portion of a firearm barrel. Thus, the threaded muzzle device attachment area 115, the reduced diameter portion 117, and the muzzle device shoulder 116 are optional elements and may or may not be included.

An externally threaded gas block attachment area 119, comprising external gas block nut 170 threads, is formed so as to extend toward the barrel chamber end 111 of the barrel 110. The threaded gas block attachment area 119 extends to a gas block attachment area 118 of the barrel body 113. The gas block attachment area 118 of the barrel body 113 has an outer diameter formed so as to allow at least a portion of the gas block attachment area 118 to be slidably positioned within the gas block barrel borehole 159 of the gas block 150.

In various exemplary embodiments, the gas block attachment area 118 has a diameter of approximately 0.075 inches. Alternatively, the gas block attachment area 118 may have a diameter of approximately 0.080 inches. It should be appreciated that the gas block attachment area 118 may have any desired diameter.

A barrel gas port 120 120 is formed within the gas block attachment area 118. The barrel gas port 120 120 extends between the barrel borehole 114 and an exterior surface of the barrel body 113. In various exemplary embodiments, the barrel gas port 120 120 is formed at a 45° angle (or 135° angle) relative to the longitudinal axis of the barrel borehole 114. In various alternative embodiments, the barrel gas port 120 120 is formed at an angle between 25° and 65° (or 115° and) 155° relative to the longitudinal axis of the barrel borehole 114. In still other exemplary embodiments, the barrel gas port 120 120 is formed at any acute, 90°, or obtuse angle relative to the longitudinal axis of the barrel borehole 114. By providing the barrel gas port 120 at such an angle, the gas port erosion caused by blast gases passing from the barrel borehole 114 through the barrel gas port 120 is reduced. This angled positioning of the barrel gas port 120 also allows the barrel gas port 120 to be positioned further forward along the barrel 110 in relation to the gas block attachment area 118.

A barrel projection 122 is formed around the barrel body 113. The barrel projection 122 extends from a barrel projection shoulder 123 to provide an abutment surface for the gas block proximal end 151 of the gas block 150. In various exemplary embodiments, the barrel projection 122 extends around and outer circumference of the barrel body 113. The barrel conical shoulder 125 forms a transition surface between the gas block attachment area 118 and a portion of the barrel projection shoulder 123. In various exemplary embodiments, the barrel conical shoulder 125 has a surface portion formed at a 30° angle (or 150° angle) relative to the barrel borehole 114 of the barrel 110. It should be appreciated that the barrel conical shoulder 125 may have a surface portion formed at another desired angle (such as an acute or obtuse angle), relative to the barrel borehole 114 of the barrel 110.

In certain exemplary embodiments, a barrel projection notch 124 is formed in a portion of the barrel projection 122. In certain exemplary embodiments, the barrel projection notch 124 is formed in a portion of the barrel projection 122, representing a top dead center or 12 o'clock alignment position of the barrel 110. In certain alternative embodiments, the barrel projection notch 124, if included, may be formed at a different desired location around the barrel projection 122. If included, the barrel projection notch 124 is formed so as to interact with at least a portion of an extension alignment protrusion 156 of the gas block 150. When the gas block 150 is installed on the barrel 110, alignment of at least a portion of the extension alignment protrusion 156 within at least a portion of the barrel projection notch 124 helps to maintain the gas block 150 in a desired rotational position relative to the barrel 110.

The muzzle adapter 130 extends from an adapter muzzle end 132 to an adapter barrel end 131.

In various exemplary embodiments, a conical taper portion 135 extends from the adapter muzzle end 132 of the muzzle adapter 130, toward the adapter barrel end 131 of the muzzle adapter 130. The outer diameter of the muzzle adapter 130 body generally expands, along the conical taper portion 135, as the conical taper portion 135 extends toward the adapter barrel end 131 of the muzzle adapter 130.

An alignment notch 136 is formed in at least a portion of the conical taper portion 135, extending from the adapter muzzle end 132 of the conical taper portion 135, toward the adapter barrel end 131 of the muzzle adapter 130. The alignment notch 136 is formed so as to interact with at least a portion of the muzzle device guide/alignment pin, such that a muzzle device can only slide onto the muzzle adapter 130 (along the longitudinal axis of the muzzle adapter 130 and muzzle device) and compress against the conical taper portion 135. Alignment of the muzzle device guide/alignment pin with the alignment notch 136 inhibits or restricts rotational movement of the muzzle device relative to the muzzle adapter 130.

A plurality of splines 137 or notches are formed at spaced apart locations around the muzzle adapter 130 body proximate the conical paper portion, toward the adapter barrel end 131 of the muzzle adapter 130. The splines 137 in the muzzle adapter 130 allow a spring pawl extension or other type of ratchet to lock the rotation of an installed muzzle device or collar until the user wishes to remove the installed muzzle device or collar. In various exemplary embodiments, each spline 137 is an elongate spline or notch, formed along the longitudinal axis of the muzzle adapter 130.

The muzzle adapter 130 includes a threaded portion having adapter threads 138 that extend along a portion of the muzzle adapter 130, between the adapter muzzle end 132 and the adapter barrel end 131. In various exemplary embodiments, the external adapter threads 138 are formed so as to interact with internal threads of a subsequent muzzle device or collar.

To aid in the installation of the muzzle adapter 130, adapter flats 139 formed of opposing parallel surfaces may be provided in various locations around the muzzle adapter 130. The flats, if included, provide parallel surfaces for a wrench or other installation device to grip the muzzle adapter 130.

An adapter alignment indicator 128, such as, for example, a recessed or marked groove, may be included proximate the adapter barrel end 131 of the muzzle adapter 130. If included, the adapter alignment indicator 128 may be aligned with a corresponding barrel alignment notch 127 formed or applied to the barrel 110. In this manner, alignment between the muzzle adapter 130 and barrel 110 can be achieved, so as to properly align the alignment notch 136 of the muzzle adapter 130 with the barrel alignment notch 127 of the barrel 110.

Figure 9:
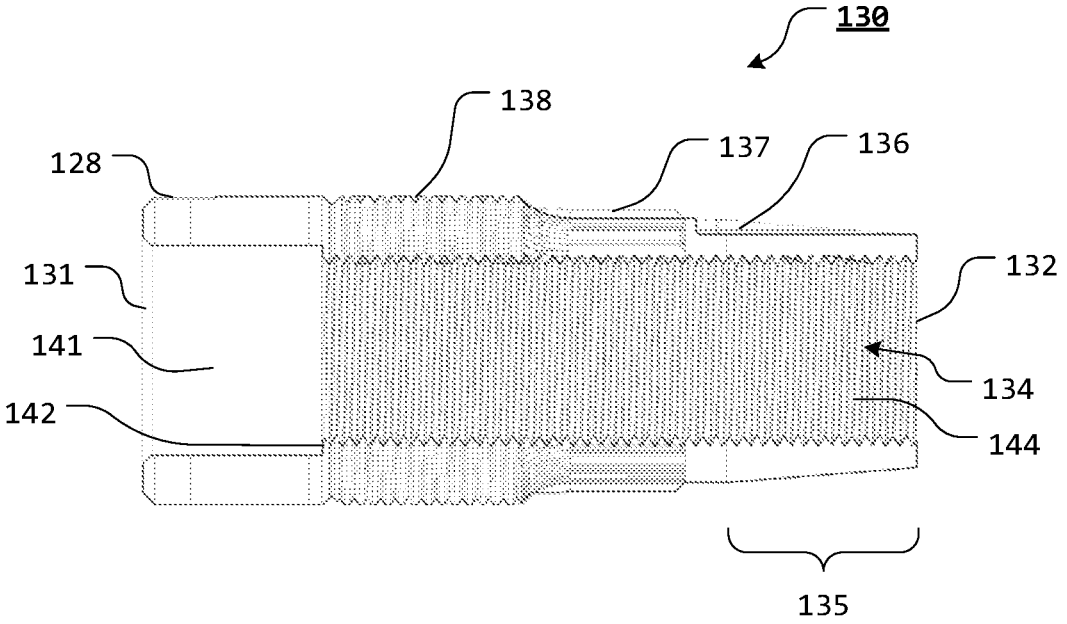
FIG. 9 illustrates a right side, cross-sectional view of an exemplary embodiment of a muzzle adapter, according to certain aspects of the presently disclosed systems, methods, and/or apparatuses.
Figure 10:
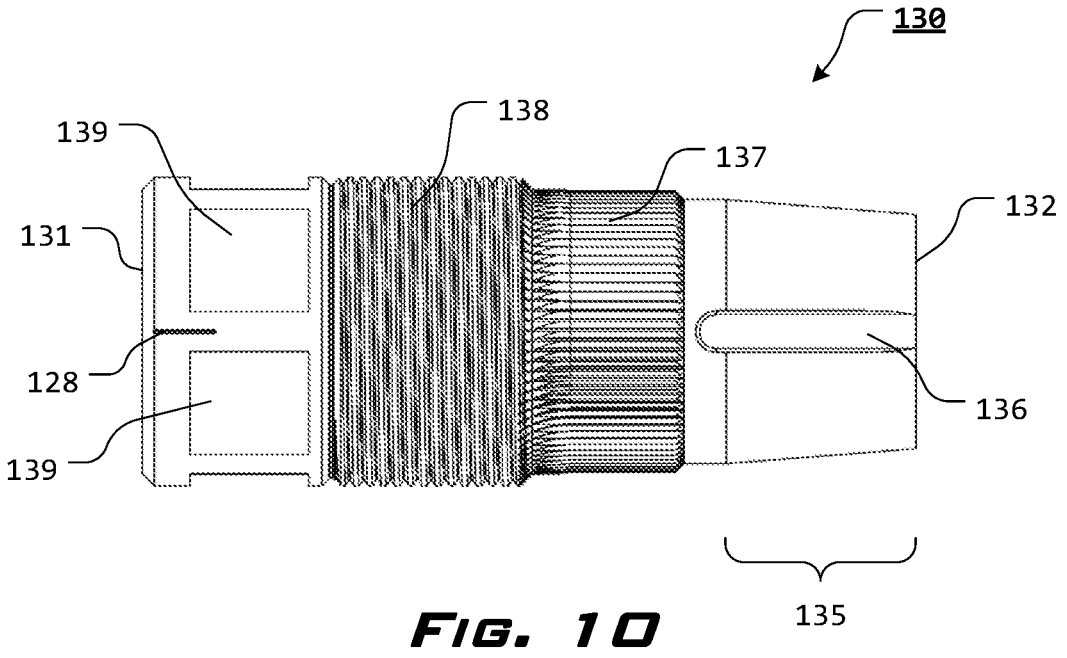
FIG. 10 illustrates a top view of an exemplary embodiment of a gas block, according to certain aspects of the presently disclosed systems, methods, and/or apparatuses.
Figure 11:
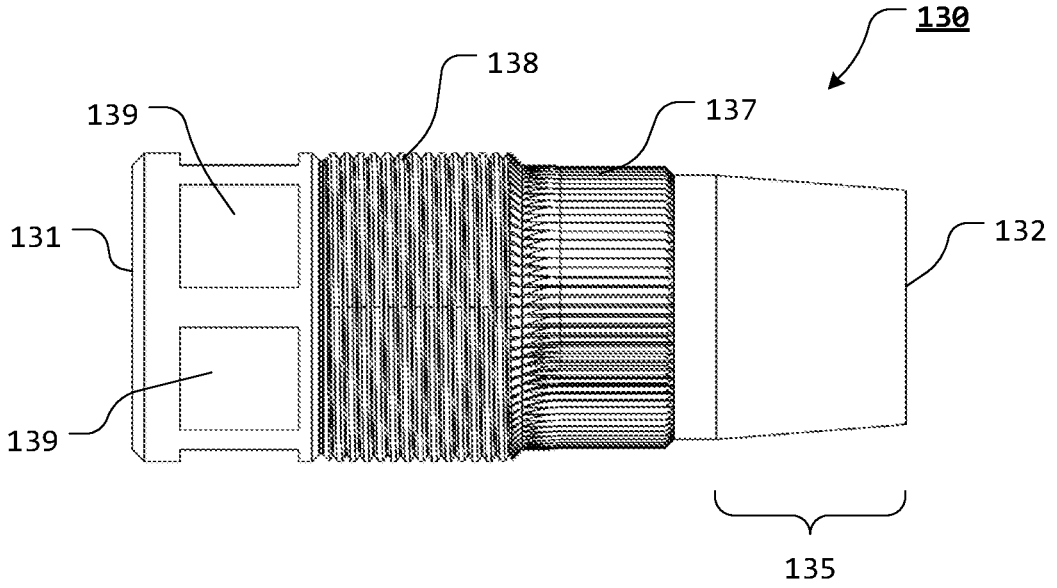
FIG. 11 illustrates a bottom view of an exemplary embodiment of a gas block, according to certain aspects of the presently disclosed systems, methods, and/or apparatuses.
Figure 12:
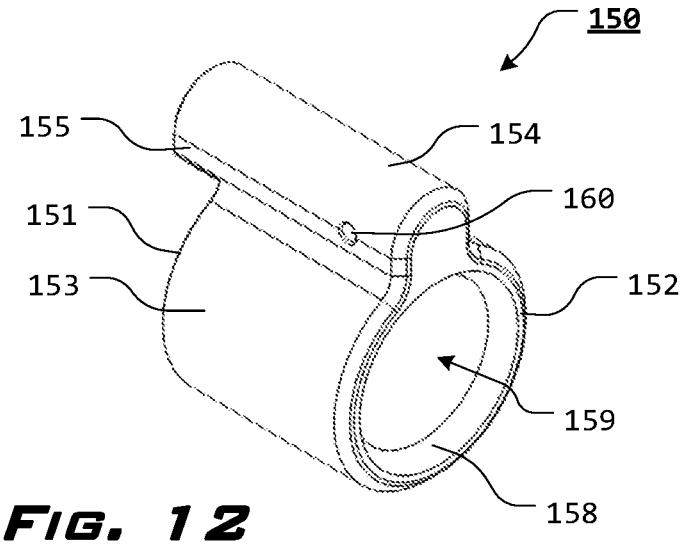
FIG. 12 illustrates an upper, front, perspective view of an exemplary embodiment of a gas block, according to certain aspects of the presently disclosed systems, methods, and/or apparatuses.
Figure 13:
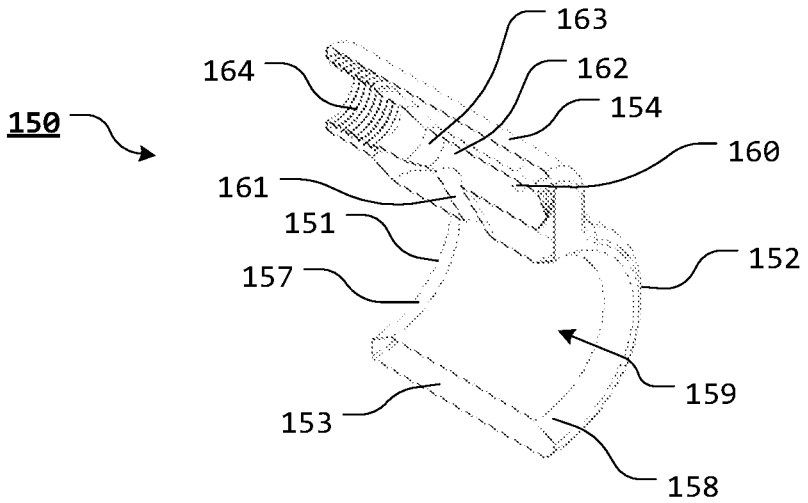
FIG. 13 illustrates an upper, front, perspective, cross-sectional view of an exemplary embodiment of a gas block, according to certain aspects of the presently disclosed systems, methods, and/or apparatuses.
Figure 14:
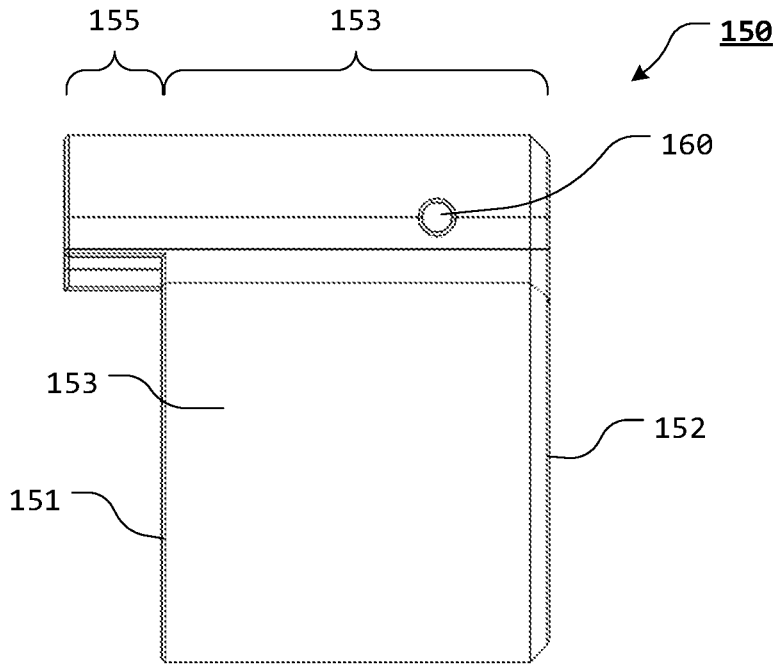
FIG. 14 illustrates a left side view of an exemplary embodiment of a gas block, according to certain aspects of the presently disclosed systems, methods, and/or apparatuses.
Figure 15:
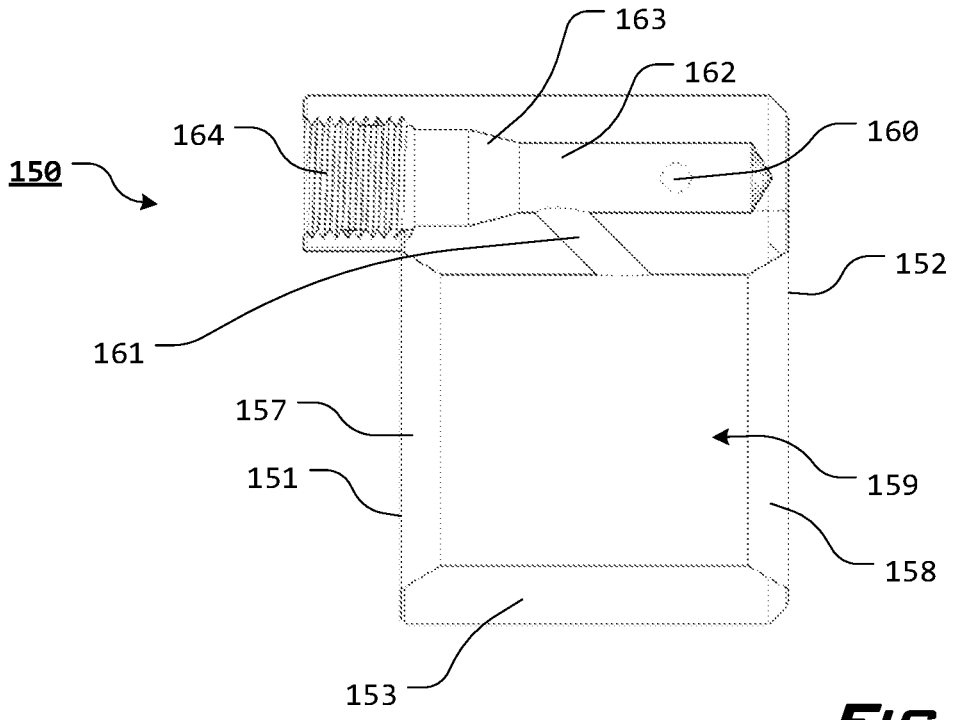
FIG. 15 illustrates a left side, cross-sectional view of an exemplary embodiment of a gas block, according to certain aspects of the presently disclosed systems, methods, and/or apparatuses.
Figure 16:
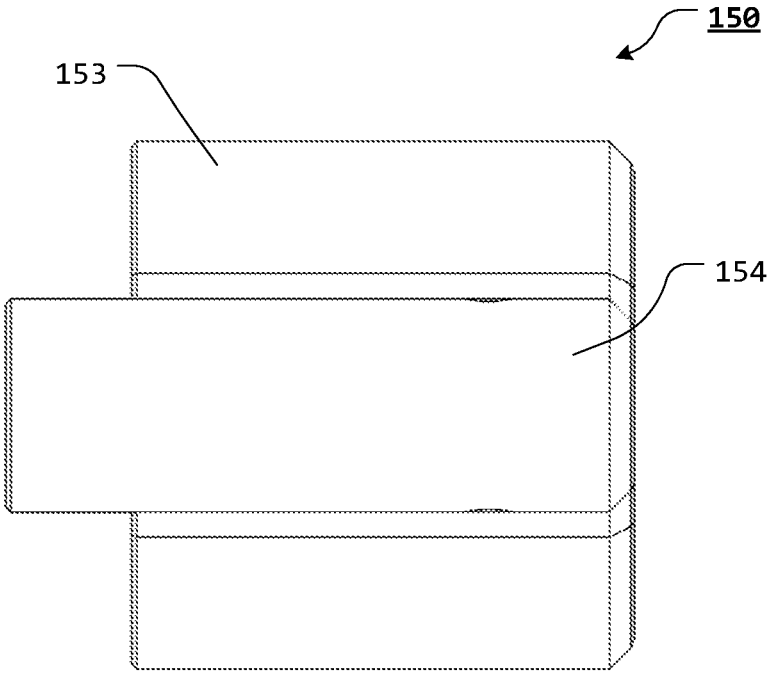
FIG. 16 illustrates a top view of an exemplary embodiment of a gas block, according to certain aspects of the presently disclosed systems, methods, and/or apparatuses.
Figure 17:
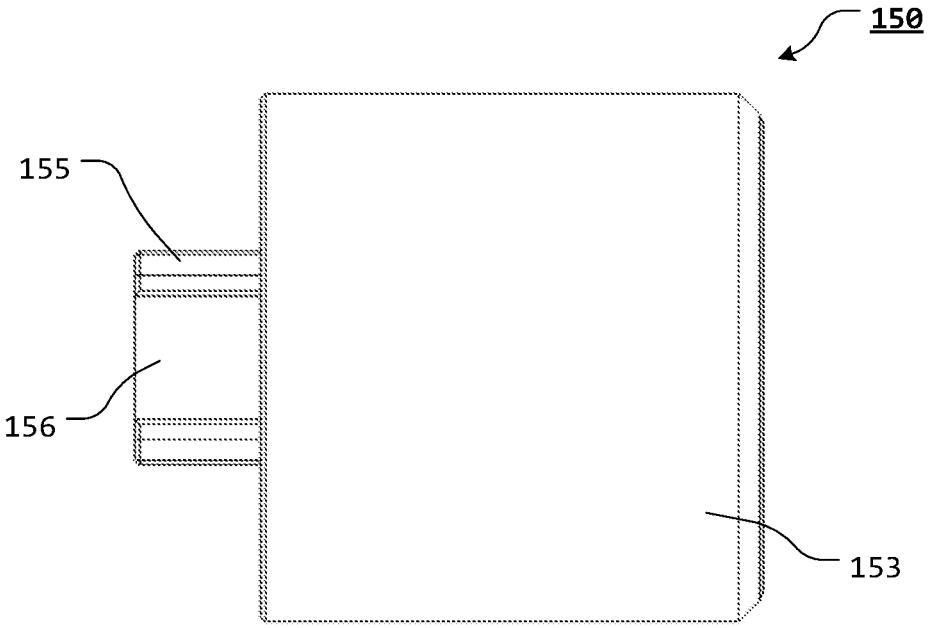
FIG. 17 illustrates a bottom view of an exemplary embodiment of a gas block, according to certain aspects of the presently disclosed systems, methods, and/or apparatuses.
Figure 18:
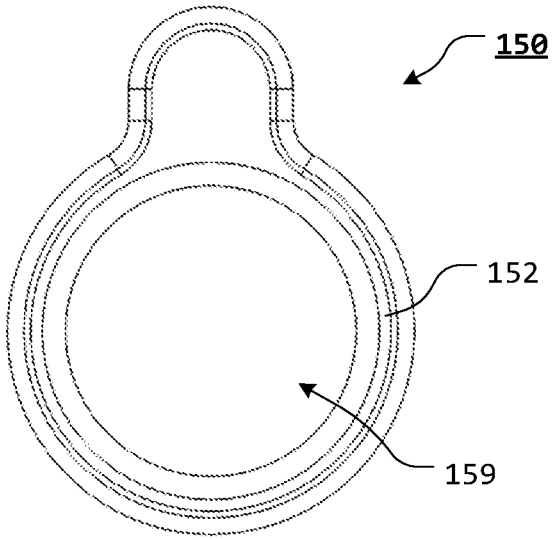
FIG. 18 illustrates a front view of an exemplary embodiment of a gas block, according to certain aspects of the presently disclosed systems, methods, and/or apparatuses.
Figure 19:
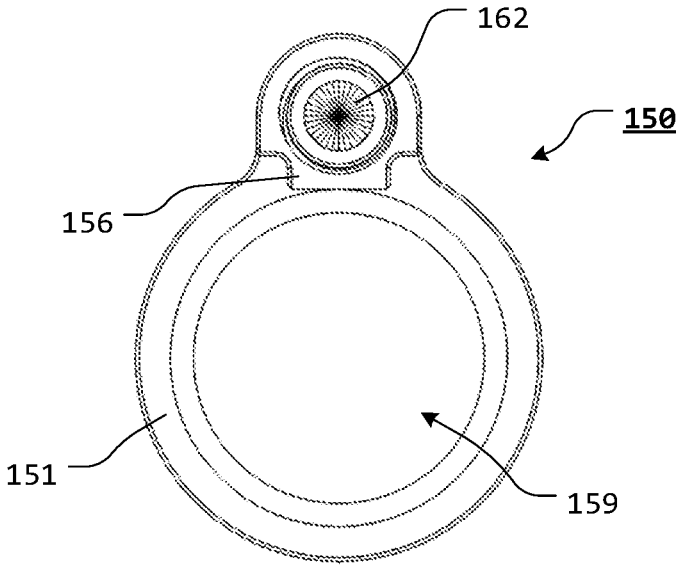
FIG. 19 illustrates a rear view of an exemplary embodiment of a gas block, according to certain aspects of the presently disclosed systems, methods, and/or apparatuses.
Figure 20:
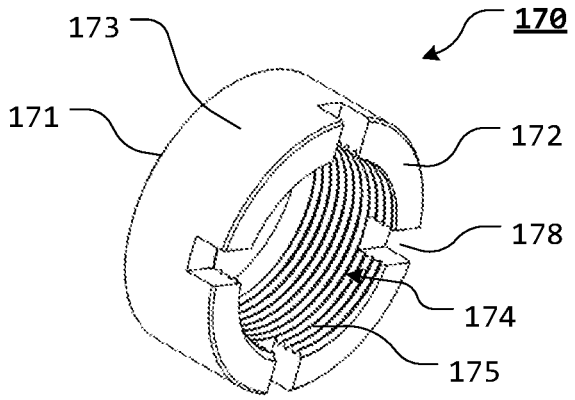
FIG. 20 illustrates an upper, front, perspective view of an exemplary embodiment of a gas block nut, according to certain aspects of the presently disclosed systems, methods, and/or apparatuses.
Figure 21:
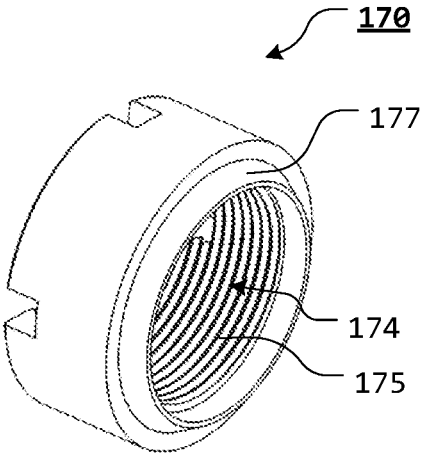
FIG. 21 illustrates an upper, rear, perspective view of an exemplary embodiment of a gas block nut, according to certain aspects of the presently disclosed systems, methods, and/or apparatuses.
Figure 22:
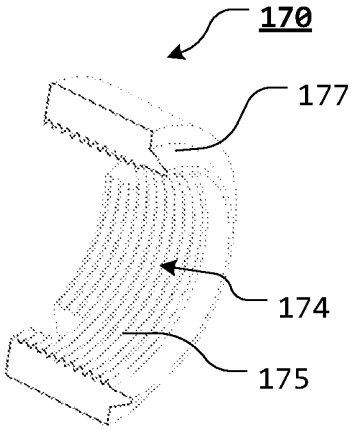
FIG. 22 illustrates an upper, rear, perspective, cross-sectional view of an exemplary embodiment of a gas block nut, according to certain aspects of the presently disclosed systems, methods, and/or apparatuses.
Figure 23:
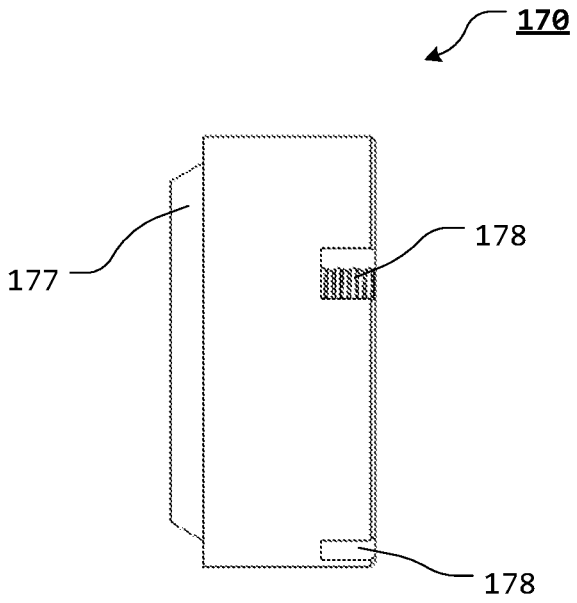
FIG. 23 illustrates a left side view of an exemplary embodiment of a gas block nut, according to certain aspects of the presently disclosed systems, methods, and/or apparatuses.
Figure 24:
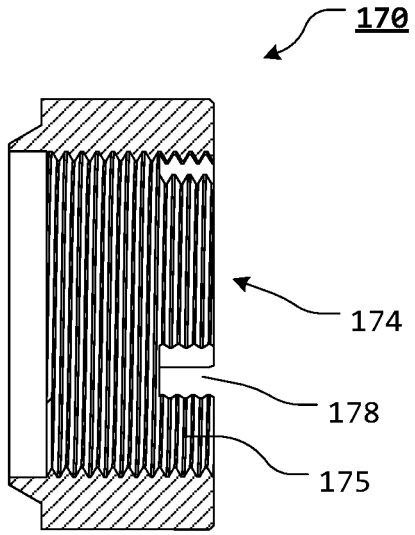
FIG. 24 illustrates a left side, cross-sectional view of an exemplary embodiment of a gas block nut, according to certain aspects of the presently disclosed systems, methods, and/or apparatuses.
Figure 25:
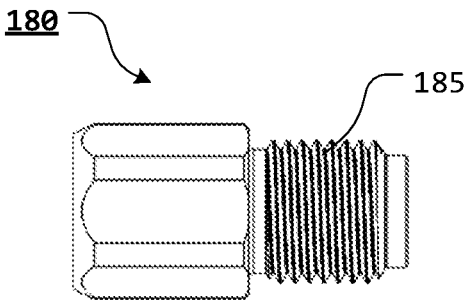
FIG. 25 illustrates a side view of an exemplary embodiment of a compression nut, according to certain aspects of the presently disclosed systems, methods, and/or apparatuses.
Figure 26:
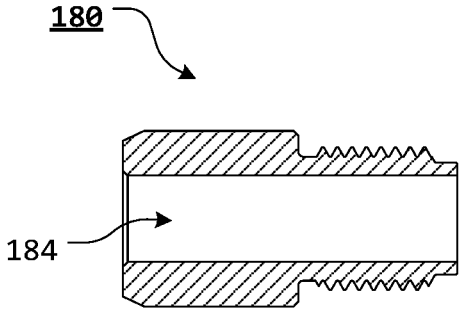
FIG. 26 illustrates a side, cross-sectional view of an exemplary embodiment of a compression nut, according to certain aspects of the presently disclosed systems, methods, and/or apparatuses.
Figure 27:
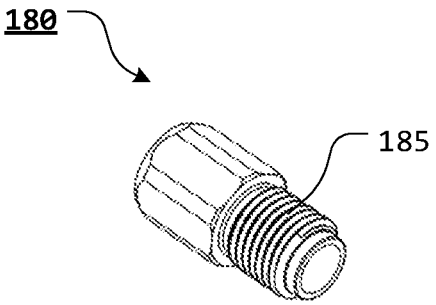
FIG. 27 illustrates a perspective view of an exemplary embodiment of a compression nut, according to certain aspects of the presently disclosed systems, methods, and/or apparatuses.
Figure 28:
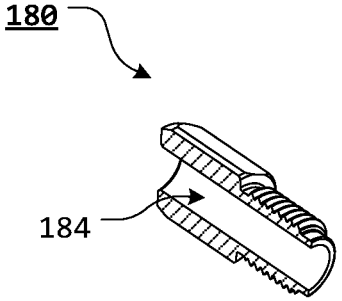
FIG. 28 illustrates a perspective, cross-sectional view of an exemplary embodiment of a compression nut, according to certain aspects of the presently disclosed systems, methods, and/or apparatuses.
Figure 29:
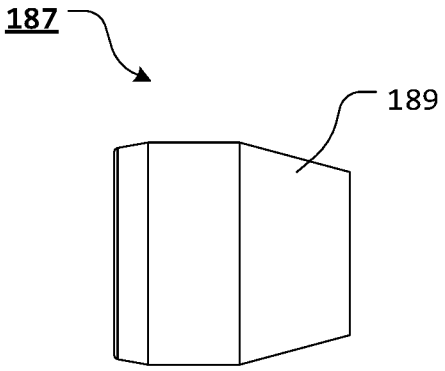
FIG. 29 illustrates a side view of an exemplary embodiment of a compression fitting, according to certain aspects of the presently disclosed systems, methods, and/or apparatuses.
Figure 30:
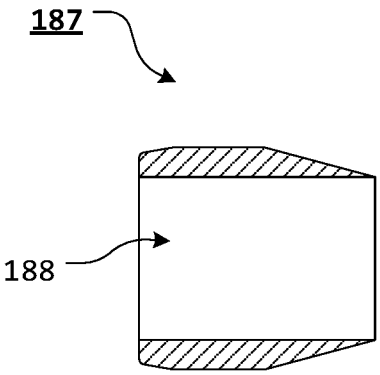
FIG. 30 illustrates a side, cross-sectional view of an exemplary embodiment of a compression fitting, according to certain aspects of the presently disclosed systems, methods, and/or apparatuses.
Figure 31:
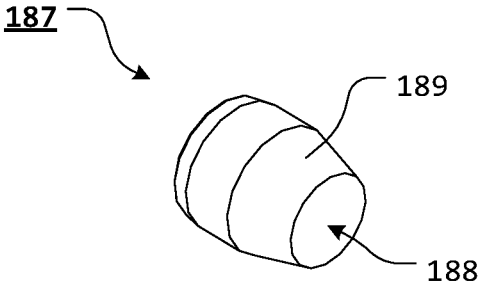
FIG. 31 illustrates a perspective view of an exemplary embodiment of a compression fitting, according to certain aspects of the presently disclosed systems, methods, and/or apparatuses.
Figure 32:
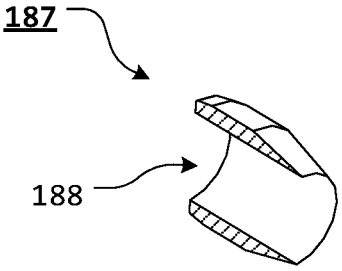
FIG. 32 illustrates a perspective, cross-sectional view of an exemplary embodiment of a compression fitting, according to certain aspects of the presently disclosed systems, methods, and/or apparatuses.
Figure 33:
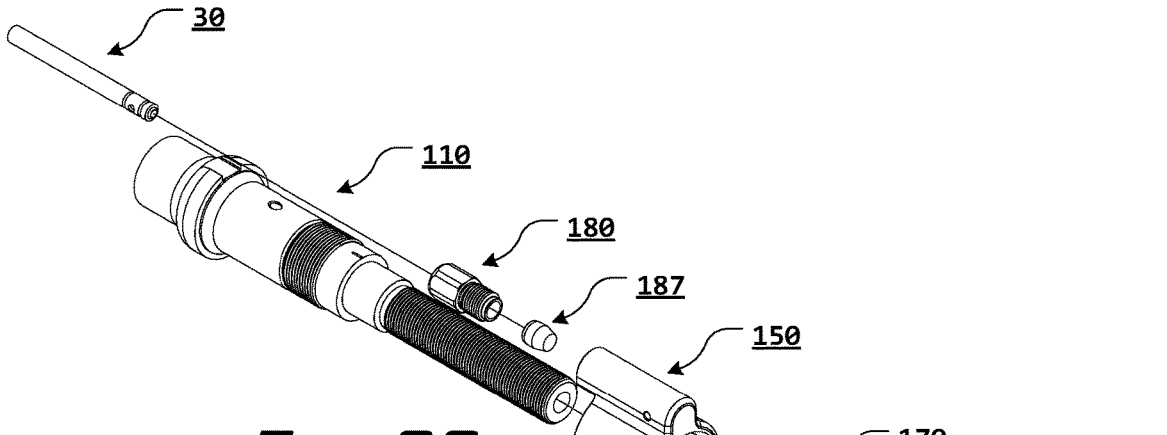
FIG. 33 illustrates an exploded view of certain exemplary components of a gas block system and muzzle device system, according to certain aspects of the presently disclosed systems, methods, and/or apparatuses.
Figure 34:
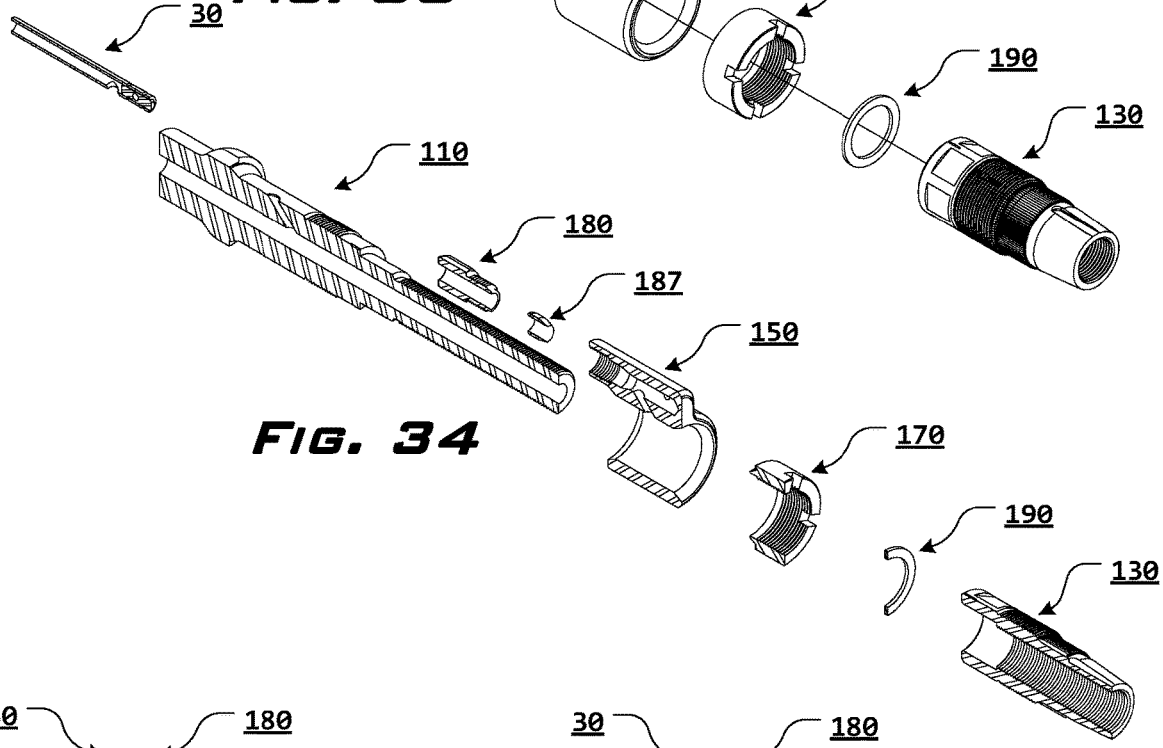
FIG. 34 illustrates an exploded, cross-sectional view of the exemplary components of the gas block system and muzzle device system of FIG. 33, according to certain aspects of the presently disclosed systems, methods, and/or apparatuses.
Figure 35:
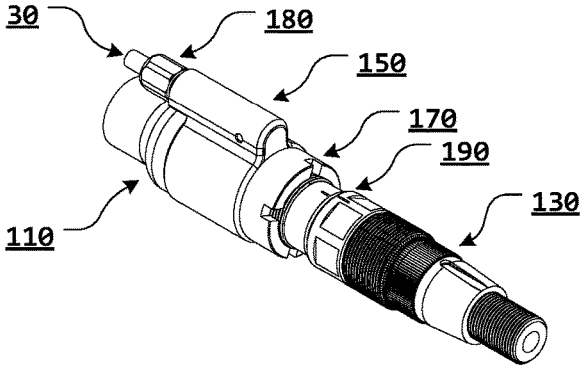
FIG. 35 illustrates a perspective view of certain exemplary components of a gas block system and muzzle device system, according to certain aspects of the presently disclosed systems, methods, and/or apparatuses.
Figure 36:
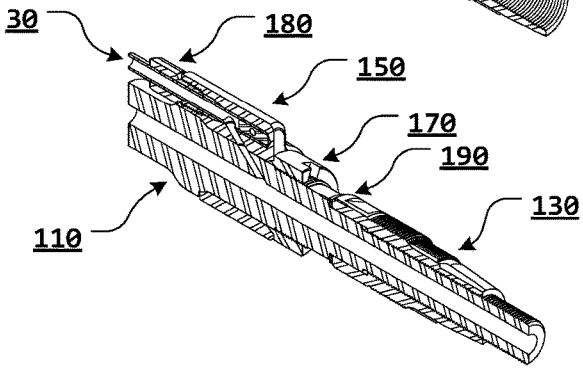
FIG. 36 illustrates a perspective, cross-sectional view of the exemplary components of the gas block system and muzzle device system of FIG. 35, according to certain aspects of the presently disclosed systems, methods, and/or apparatuses.
Figure 37:
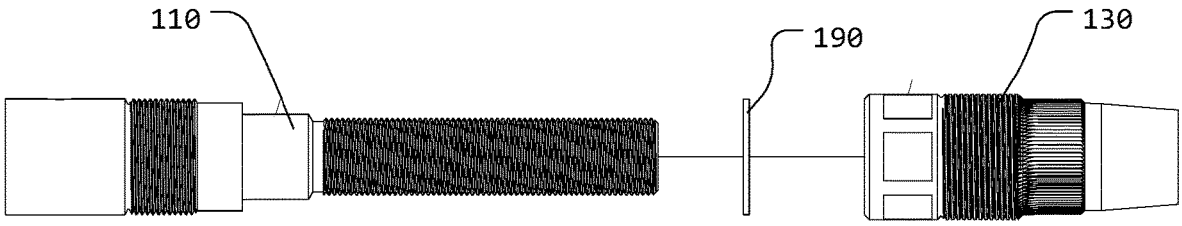
FIG. 37 illustrates an exploded view of certain exemplary components of a muzzle device system, according to certain aspects of the presently disclosed systems, methods, and/or apparatuses.
Figure 38:
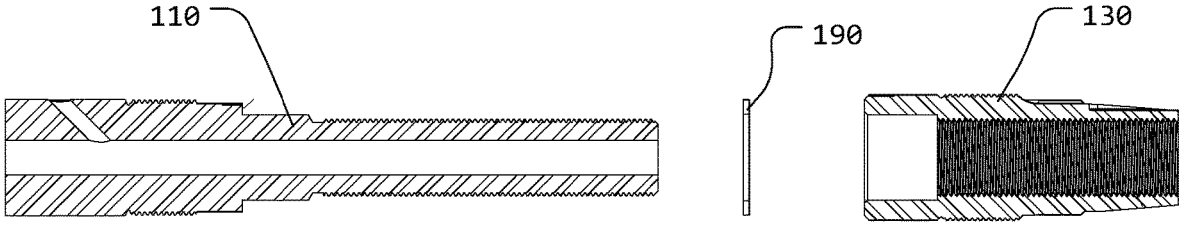
FIG. 38 illustrates an exploded, cross-sectional view of certain exemplary components of a muzzle device system, according to certain aspects of the presently disclosed systems, methods, and/or apparatuses.
Figure 39:
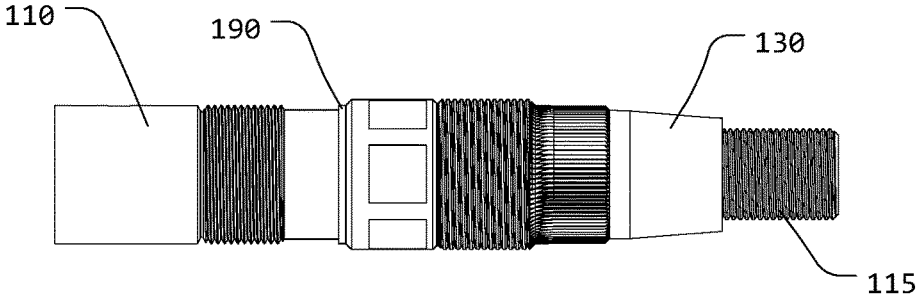
FIG. 39 illustrates a side view of certain exemplary components of a muzzle device system, according to certain aspects of the presently disclosed systems, methods, and/or apparatuses.
Figure 40:
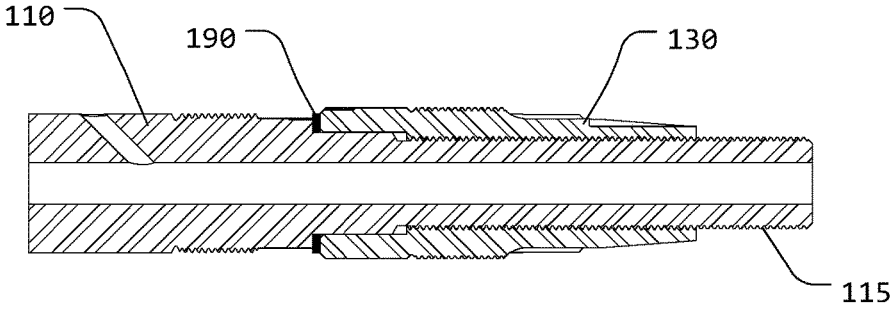
FIG. 40 illustrates a side, cross-sectional view of certain exemplary components of a muzzle device system, according to certain aspects of the presently disclosed systems, methods, and/or apparatuses.
Figure 41:
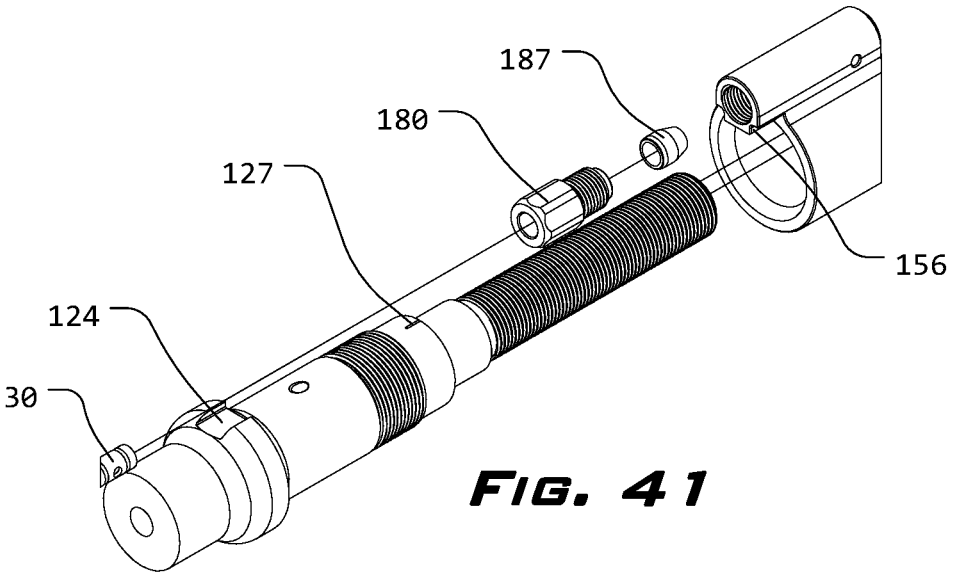
FIG. 41 illustrates a rear, perspective, exploded view of certain exemplary components of a gas block system, according to certain aspects of the presently disclosed systems, methods, and/or apparatuses.
Figure 42:
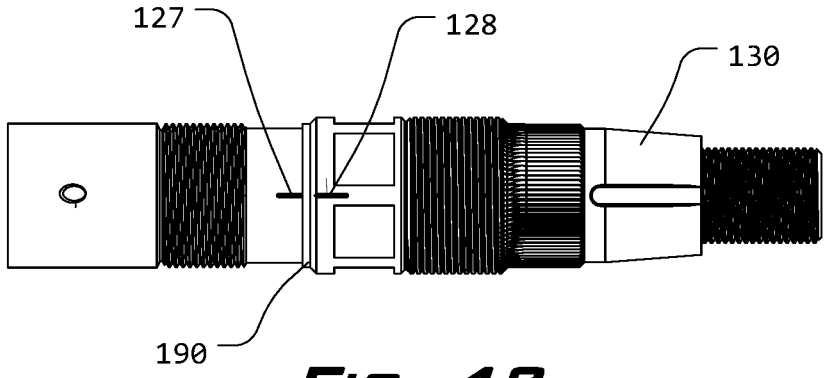
FIG. 42 illustrates a top view of certain exemplary components of a muzzle device system, according to certain aspects of the presently disclosed systems, methods, and/or apparatuses.
Figure 43:
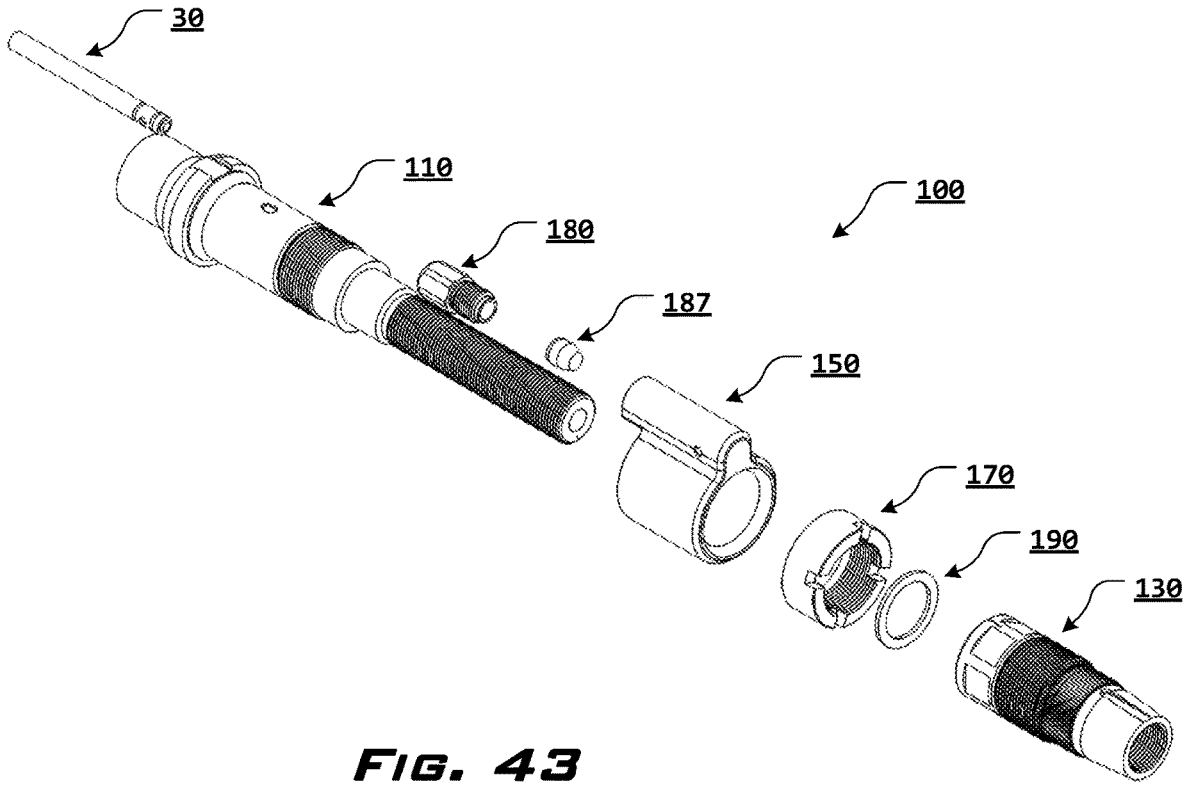
FIG. 43 illustrates a front, perspective, exploded view of certain exemplary components of a gas block system and muzzle device system, according to certain aspects of the presently disclosed systems, methods, and/or apparatuses.
Figure 44:
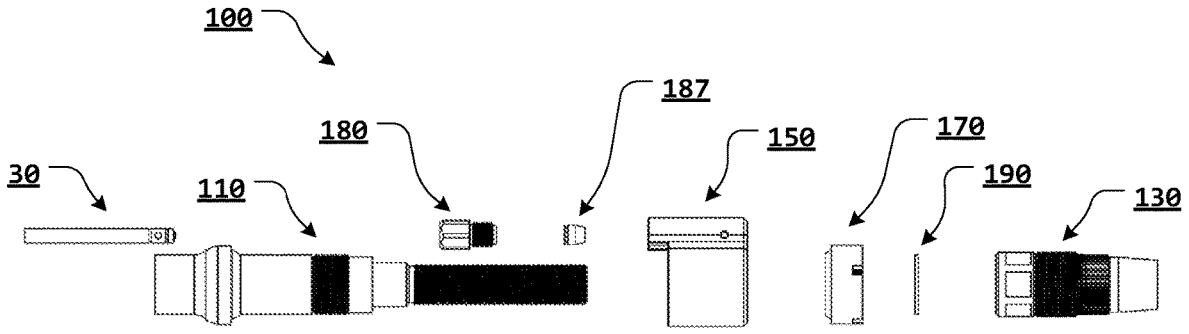
FIG. 44 illustrates a side, exploded view of certain exemplary components of a gas block system and muzzle device system, according to certain aspects of the presently disclosed systems, methods, and/or apparatuses.
Figure 45:
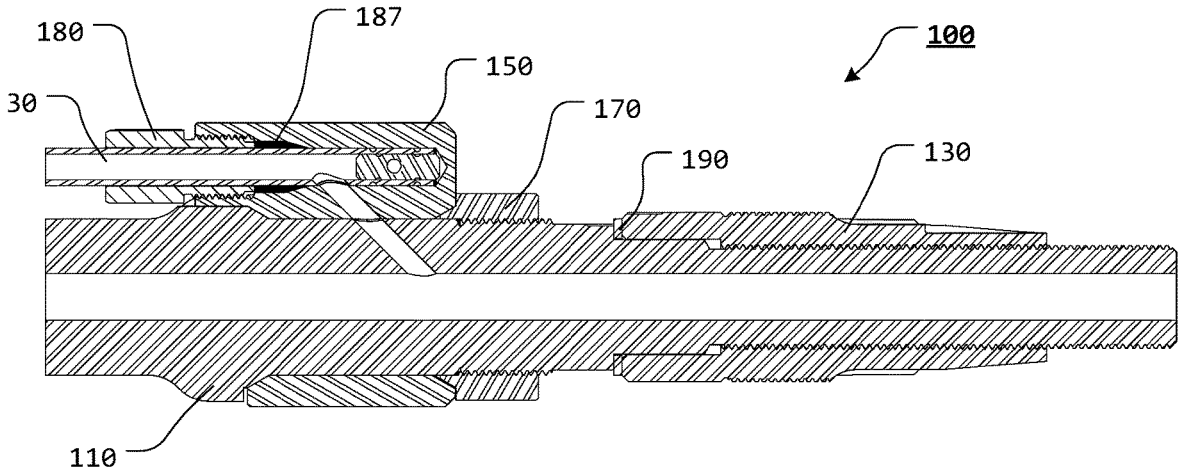
FIG. 45 illustrates a side, cross-sectional view of certain exemplary components of a gas block system and muzzle device system, according to certain aspects of the presently disclosed systems, methods, and/or apparatuses.

As illustrated most clearly in FIG. 9, the muzzle adapter 130 comprises a muzzle adapter aperture 134 extending from the adapter muzzle end 132 to the adapter barrel end 131. Muzzle adapter aperture 134 includes an initial aperture portion 141 having a first inner diameter as the muzzle adapter aperture 134 extends from the adapter barrel end 131, toward the adapter muzzle end 132. An inner adapter aperture shoulder 142 is formed within the muzzle adapter aperture 134 and the muzzle adapter aperture 134 has a second, smaller, inner diameter, within a threaded aperture portion 144, as the muzzle adapter aperture 134 extends from the inner adapter aperture shoulder 142 to the adapter muzzle end 132.

Muzzle adapter 130 threads are formed within the threaded aperture portion 144 of the muzzle adapter aperture 134, extending from the inner adapter aperture shoulder 142, toward or to the adapter muzzle end 132 of the muzzle adapter 130. The muzzle adapter 130 threads are formed so as to be threadedly attached to the external threads of the threaded muzzle device attachment area 115 of the barrel 110.

During installation of the muzzle adapter 130 on the barrel 110, as illustrated most clearly in FIGS. 37-40, the barrel 110 is positioned through the initial aperture portion 141 of the muzzle adapter 130 and the internal threads of the threaded aperture portion 144 of the muzzle adapter 130 interact with the external threads of the threaded muzzle device attachment area 115 to secure the muzzle adapter 130 to the barrel 110. When appropriately secured, at least a portion of the reduced diameter portion 117 of the barrel 110 is positioned within the initial aperture portion 141 of the muzzle adapter 130. The adapter barrel end 131 of the muzzle adapter 130 may optionally be abutted against the muzzle device shoulder 116 of the barrel 110.

In certain exemplary embodiments, during installation, one or more timing shims 190 may be positioned around the threaded muzzle device attachment area 115, between the adapter barrel end 131 of the muzzle adapter 130 and the barrel projection shoulder 123. As a muzzle device is rotationally installed on the barrel 110, the one or more timing shims 190 may be abutted between the adapter barrel end 131 of the muzzle adapter 130 and the muzzle device shoulder 116 of the barrel 110. By including one or more timing shims 190, if needed, the rotational position of the muzzle adapter 130, relative to the barrel 110, may be controlled so that the muzzle adapter 130 may be torqued to a desired specification.

As illustrated most clearly in FIGS. 12-19, the gas block 150 extends, substantially parallel to a longitudinal axis $A_L$, from a gas block proximal end 151 to a gas block distal end 152 and includes a gas block body portion 153 and a gas block portion 154. A gas block borehole 159 extends through the gas block body portion 153, along the longitudinal axis $A_L$. The gas block borehole 159 is adapted to receive at least a portion of the barrel 110 therethrough. In various exemplary embodiments, the gas block borehole 159 is adapted to receive a portion of the gas block attachment area 118 of the barrel 110 therethrough.

A tapered proximal shoulder 157 is formed in the gas block proximal end 151 of the gas block borehole 159. The size, shape, and angle of the tapered proximal shoulder 157 corresponds to the size, shape, and angle of the barrel conical shoulder 125. Thus, as the gas block proximal end 151 of the gas block body portion 153 is urged toward the barrel projection shoulder 123, the barrel conical shoulder 125 interacts with the tapered proximal shoulder 157 to form a gas seal between the gas block 150 and the barrel 110.

As illustrated most clearly in FIGS. 20-24, the gas block nut 170 includes a gas block nut body portion 173 that extends, substantially parallel to a longitudinal axis $A_L$, from a gas block nut proximal end 171 to a gas block nut distal end 172 and includes a tapered extension portion 177 that extends from the gas block nut proximal end 171 of the gas block nut 170. One or more securing notches 178 may optionally be formed in the gas block nut distal end 172 of the gas block nut 170. A gas block nut aperture 174 extends through the gas block nut 170, along the longitudinal axis $A_L$, and is adapted to receive at least a portion of the barrel 110 therethrough. An internally threaded gas block nut aperture portion 175 is formed within at least a portion of the gas block nut aperture 174. The internally threaded gas block nut aperture portion 175 is adapted to interact with the external threads of the threaded gas block attachment area 119 of the barrel 110 to secure the gas block nut 170 to the barrel 110.

While the gas block nut 170 is illustrated as having a substantially cylindrical shape, much like a castle nut, it should be appreciated that the gas block nut 170 may comprise any alternative shapes, such as, for example, a hex nut.

A tapered extension portion 177 extends from the gas block nut proximal end 171 of the gas block nut 170.

A tapered distal shoulder 158 is formed in the gas block distal end 152 of the gas block borehole 159. The size, shape, and angle of the tapered distal shoulder 158 corresponds to the size, shape, and angle of the tapered extension portion 177 of the gas block nut 170. Thus, as the gas block distal end 152 of the gas block body portion 153 is contacted by the tapered extension portion 177 of the gas block nut 170 and the gas block nut 170 is urged toward the barrel projection shoulder 123, the tapered extension portion 177 interacts with the tapered distal shoulder 158 to form a gas seal between the gas block 150 and the gas block nut 170.

Various exemplary embodiments, the tapered proximal shoulder 157 and the tapered distal shoulder 158 comprise a 30° angled surface. In certain embodiments, the tapered proximal shoulder 157 and the tapered distal shoulder 158 comprise angled surfaces having a 20°-40° angle. However, it should be appreciated that the angled surfaces of the tapered proximal shoulder 157 and the tapered distal shoulder 158 to be any desired angle. Furthermore, the angle of the tapered proximal shoulder 157 and the tapered distal shoulder 158 may be the same or different angles. The barrel conical shoulder 125 and the tapered extension portion 177 are formed at complementary angles the angled surfaces of the tapered proximal shoulder 157 and tapered distal shoulder 158.

The gas block portion 154 extends from the gas block body portion 153 and includes a gas block gas port 161 and a gas tube borehole 162. A gas block extension portion 155 extends from an upper portion of the gas block portion 154.

Various exemplary embodiments, an extension alignment protrusion 156 extends from at least a portion of the gas block extension portion 155 of the gas block 150. When the gas block 150 is installed on the barrel 110, interaction of the barrel projection notch 124 and the extension alignment protrusion 156 helps to maintain the gas block 150 in a desired rotational position relative to the barrel 110.

In various exemplary, nonlimiting embodiments, at least a portion of the gas block extension portion 155 extends beyond at least a portion of the gas block portion 154 and the gas block body portion 153.

A gas tube borehole 162 extends from the gas block proximal end 151 of the gas block extension portion 155 and into at least a portion of the gas block extension portion 155. In various exemplary embodiments, the gas tube borehole 162 extends along the longitudinal axis $A_L$ of the gas block extension portion 155, parallel to the gas block barrel borehole 159.

The gas tube borehole 162 includes an internally threaded portion 164 and a tapered borehole portion 163. As illustrated most clearly in FIGS. 33-36, 41, and 43-45, the gas tube borehole 162 is formed so as to receive an end portion gas tube 30 therein. In various exemplary embodiments, the gas tube 30 may optionally be secured within the gas tube borehole 162 by the interaction of a role pin positioned through aligned roll pin apertures 160 of the gas block 150 and the gas tube 30.

At least a portion of the gas tube borehole 162, extending from the gas block proximal end 151 of the gas block portion 154 includes an internally threaded portion 164. The gas tube borehole 162 is adapted to receive at least a portion of the compression nut threaded portion 185 of the compression nut 180 therein. At least a portion of the compression nut 180 includes a compression nut threaded portion 185. The internally threaded portion 164 of the gas tube borehole 162 and the compression nut threaded portion 185 of the compression nut 180 include corresponding, mateable, external threads, such that the compression nut 180 is able to be at least partially threadedly attached or coupled to the gas tube borehole 162, via interaction of the compression nut threaded portion 185 of the compression nut 180 and the internally threaded portion 164 of the gas tube borehole 162.

In accordance with various exemplary embodiments of the present disclosure, the gas tube 30 may be secured or further secured within the gas tube borehole 162 by interaction of a compression nut 180 and a compression fitting 187. In various exemplary, nonlimiting embodiments, the compression fitting 187 includes one or more compression fitting tapered portions 189. A portion of the gas tube 30 is positioned through the compression fitting aperture 188 of the compression fitting 187 and the compression nut aperture 184 of the compression nut 180. The gas tube 30 is then positioned within the gas tube borehole 162 such that the compression fitting 187 interacts with the tapered borehole portion 163. Interaction of the internally threaded portion 164 of the gas tube borehole 162 and the compression nut threaded portion 185 of the compression nut 180 allow the compression nut 180 to be further secured within the gas tube borehole 162. The compression fitting 187 (in the general form of an "Olive" or "Ferrule") is compressed to form an effective seal between the gas tube 30 and the tapered borehole portion 163. While the gas tube 30 may optionally be held in position by the roll pin, the seal between the gas tube 30, the tapered borehole portion 163, and the compression fitting 187 prevent gases from leaking along the tube and venting out of the rear of the gas block 150. Thus, while the gas tube 30 is held in place with a traditional roll pin for additional safety, the compression nut 180 that compresses the compression fitting 187 (olive or ferrule) to seal the gas tube 30 to the gas block 150.

A gas block gas port 161 is disposed between the gas block barrel borehole 159 and the gas tube borehole 162, such that the gas block barrel borehole 159 is in fluid communication with the gas tube borehole 162, via the gas block gas port 161. The gas block gas port 161 is formed such that, when the gas block system 100 is properly secured to a barrel 110 and a gas tube 30 is properly secured within the gas tube borehole 162, as illustrated, for example, in FIGS. 35, 38, and 39, the barrel gas port 120 is aligned with and in fluid communication with the gas block gas port 161 such that the barrel borehole 114 is in fluid communication (via the barrel gas port 120, the gas block gas port 161, and the gas tube borehole 162) with the gas tube 30.

In various exemplary embodiments, various components of the gas block system 100 are substantially rigid and are formed of steel. Alternate materials of construction of the various components of the gas block system 100 may include one or more of the following: titanium, aluminum, stainless steel, and/or other metals, as well as various alloys and composites thereof, glass-hardened polymers, polymeric composites, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset materials, and/or various combinations of the foregoing. Thus, it should be understood that the material or materials used to form the various components of the gas block system 100 is a design choice based on the desired appearance and functionality of the gas block system 100.

It should be appreciated that certain elements of the gas block system 100 may be formed as an integral unit (such as, for example, the gas block portion 154 and the gas block extension portion 155). Alternatively, suitable materials can be used and sections or elements made independently and attached or coupled together, such as by adhesives, welding, screws, rivets, pins, or other fasteners, to form the various elements of the gas block system 100.

It should also be understood that the overall size and shape of the gas block system 100 and the various portions thereof is a design choice based upon the desired functionality and/or appearance of the gas block system 100.

During assembly and use, a portion of the gas tube 30 is positioned through the compression nut 180 and the compression fitting 187. The gas tube 30 is then attached or coupled to the gas block 150 (within the gas tube borehole 162), via interaction of a role pin through the roll pin apertures 160 of gas block 150 and the roll pin aperture of the gas tube 30. Once the gas tube 30 is appropriately positioned, the compression nut 180 is threadedly attached or coupled to the gas block portion 154, via interaction of the compression nut threaded portion 185 of the compression nut 180 and the internally threaded portion 164 of the gas block 150, securing the compression fitting 187 within the gas tube borehole 162.

The gas block 150 is positioned such that the barrel muzzle end 112 of the barrel 110 is urged through the gas block barrel borehole 159 and the gas block proximal end 151 of the gas block body portion 153 is urged against the barrel conical shoulder 125, such that the tapered proximal shoulder 157 contacts the barrel conical shoulder 125. If included, the extension alignment protrusion 156 is aligned with the barrel projection notch 124.

The gas block nut 170 is then positioned such that the barrel muzzle end 112 of the barrel 110 is urged through the gas block nut aperture 174 such that the threaded gas block nut aperture portion 175 contacts the threaded gas block attachment area 119. As the gas block nut 170 is rotated relative to the barrel 110, interaction between the external threads of threaded gas block nut aperture portion 175 and the internal threads of the threaded gas block attachment area 119 urged the gas block nut 170 toward the gas block 150. As the gas block nut 170 is further or urged toward the gas block 150, the tapered extension portion 177 contacts the tapered distal shoulder 158 of the gas block 150. The gas block nut 170 is still further urged toward the gas block 150, the gas block nut 170 creates a sufficient seal between the tapered proximal shoulder 157 of the gas block 150 and the barrel conical shoulder 125 of the barrel 110 and the tapered distal shoulder 158 of the gas block 150 and the tapered extension portion 177 of the gas block nut 170 to create a gas seal between the gas block 150 and the barrel 110.

Thus, the gas block barrel borehole 159 of the gas block 150 is now very effectively sealed. The gas block 150 is also positioned concentric to the outer diameter of the barrel 110 rather than being clamped down onto the top surface of the barrel 110. This helps harmonics of the barrel 110 when fired.

When the gas block 150 is appropriately attached or coupled to the barrel 110 and the gas tube 30 is attached or coupled to the gas block 150, the barrel gas port 120 is aligned with and in fluid communication with the gas block gas port 161 such that the barrel borehole 114 is in fluid communication (via the barrel gas port 120, the gas block gas port 161, and the gas tube borehole 162) with the gas tube 30.

Figure 46:
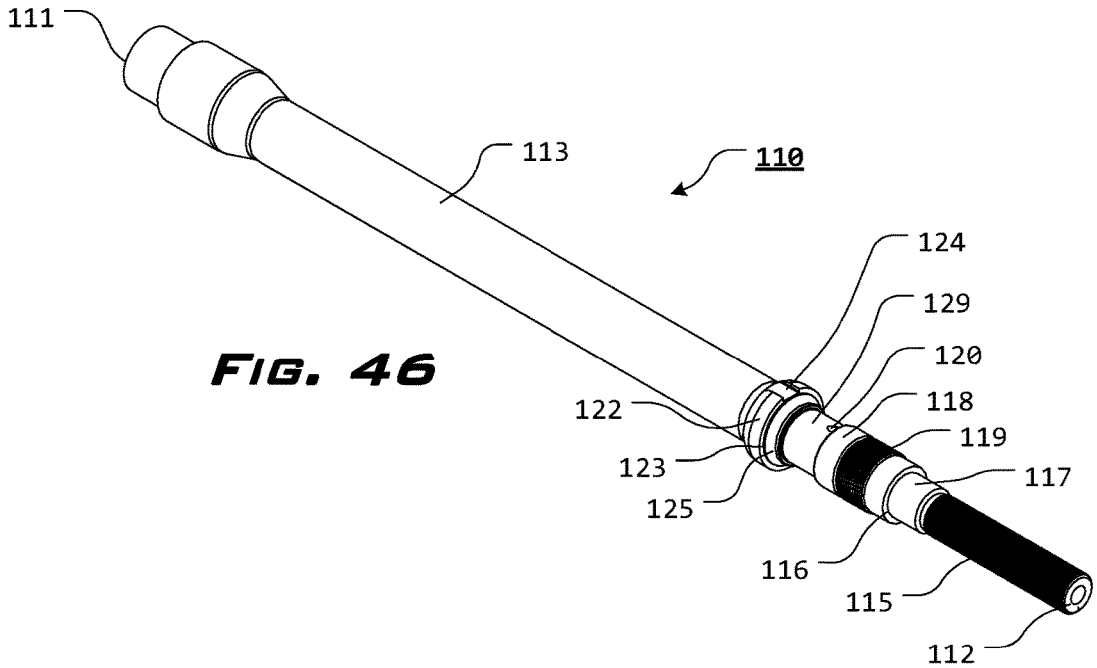
FIG. 46 illustrates an upper, front, perspective view of an exemplary embodiment of a barrel, according to certain aspects of the presently disclosed systems, methods, and/or apparatuses.
Figure 47:
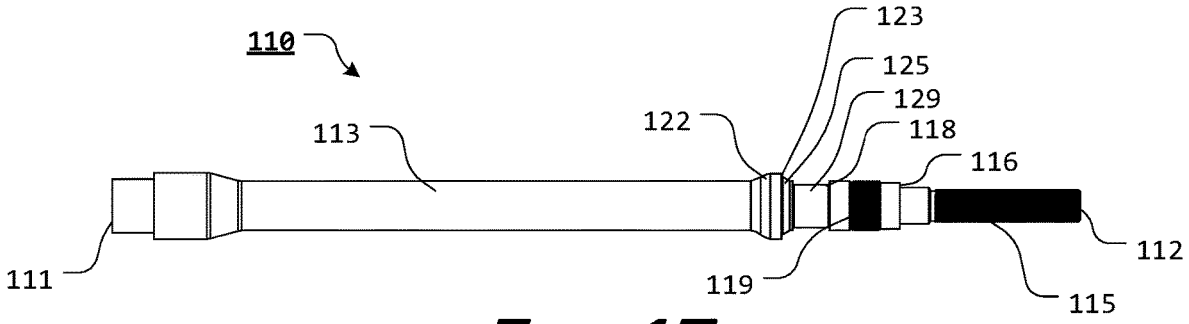
FIG. 47 illustrates a left side view of an exemplary embodiment of a barrel, according to certain aspects of the presently disclosed systems, methods, and/or apparatuses.
Figure 48:
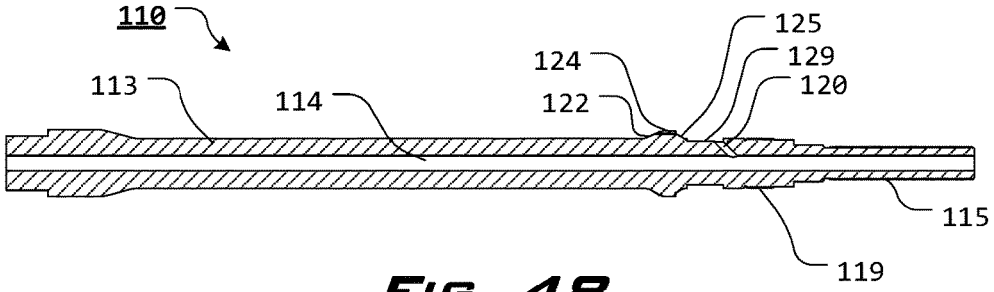
FIG. 48 illustrates a left side, cross-sectional view of an exemplary embodiment of a barrel, according to certain aspects of the presently disclosed systems, methods, and/or apparatuses.
Figure 49:
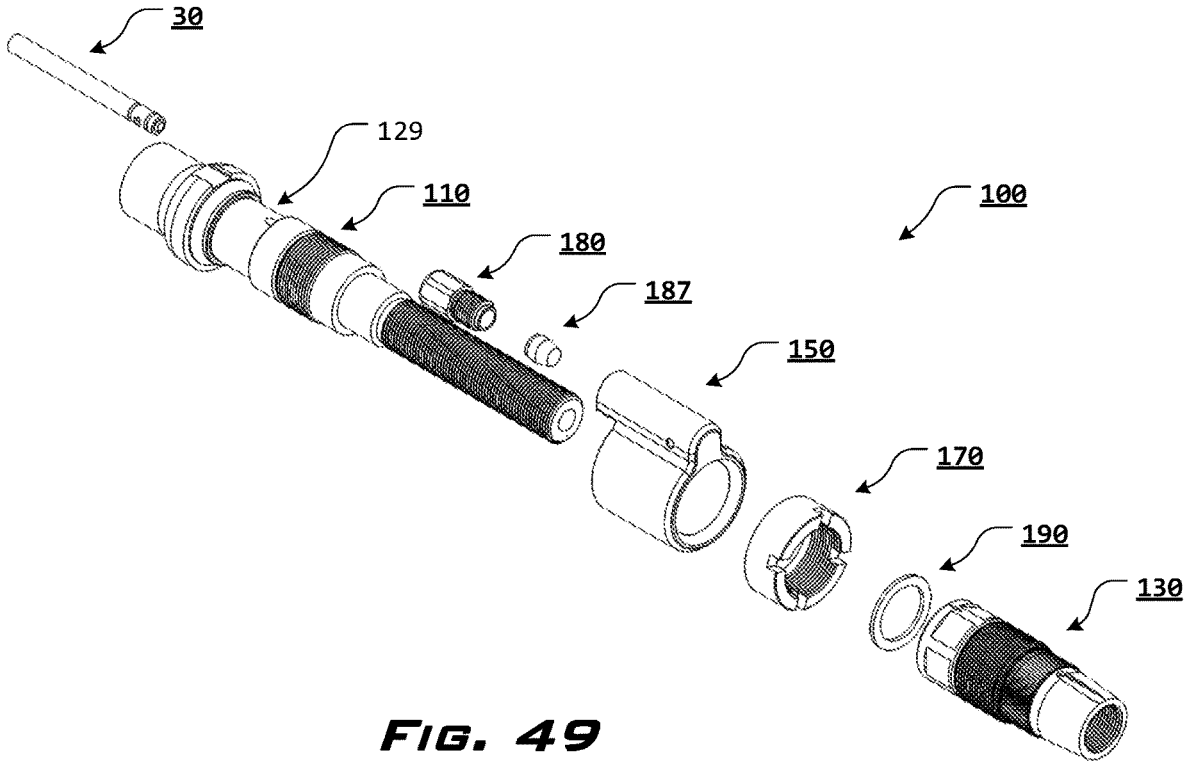
FIG. 49 illustrates a front, perspective, exploded view of certain exemplary components of a gas block system and muzzle device system, according to certain aspects of the presently disclosed systems, methods, and/or apparatuses.
Figure 50:
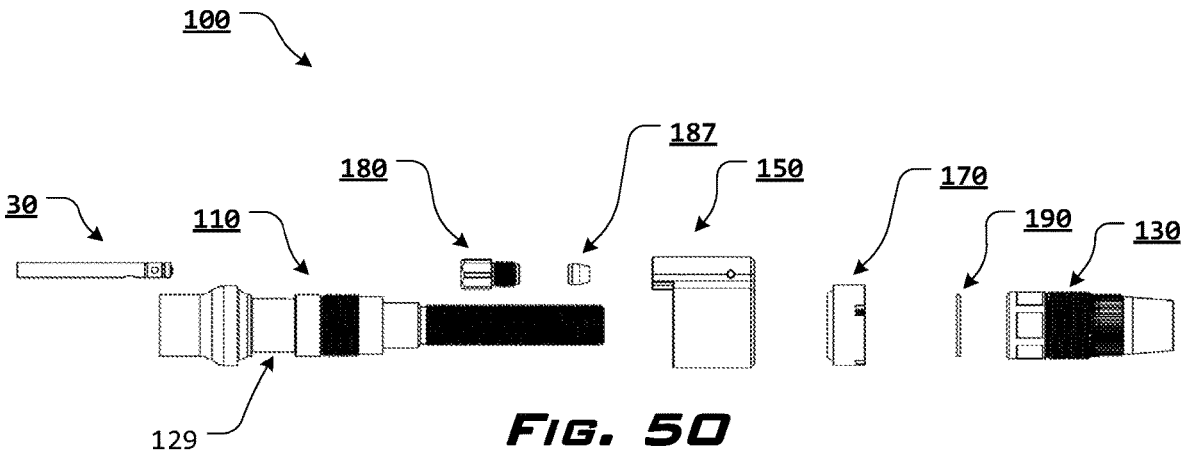
FIG. 50 illustrates a side, exploded view of certain exemplary components of a gas block system and muzzle device system, according to certain aspects of the presently disclosed systems, methods, and/or apparatuses.

FIGS. 46-48 illustrates an exemplary embodiment of the barrel 110, wherein a gas expansion recess 129 is formed in a portion of the gas block attachment area 118. Certain exemplary embodiments, the gas expansion recess 129 is formed of a portion of the gas block attachment area 118 having a decreased diameter relative to the remaining portion of the gas block attachment area 118. Alternatively, the gas expansion recess 129 may be formed of a grooved portion, a spiral groove, a reduced diameter portion 117 of the barrel 110, etc. The gas expansion recess 129 may take any shape or form, so long as the gas expansion recess 129 provides fluid communication between the barrel gas port 120 and the gas block gas port 161.

Figure 51:
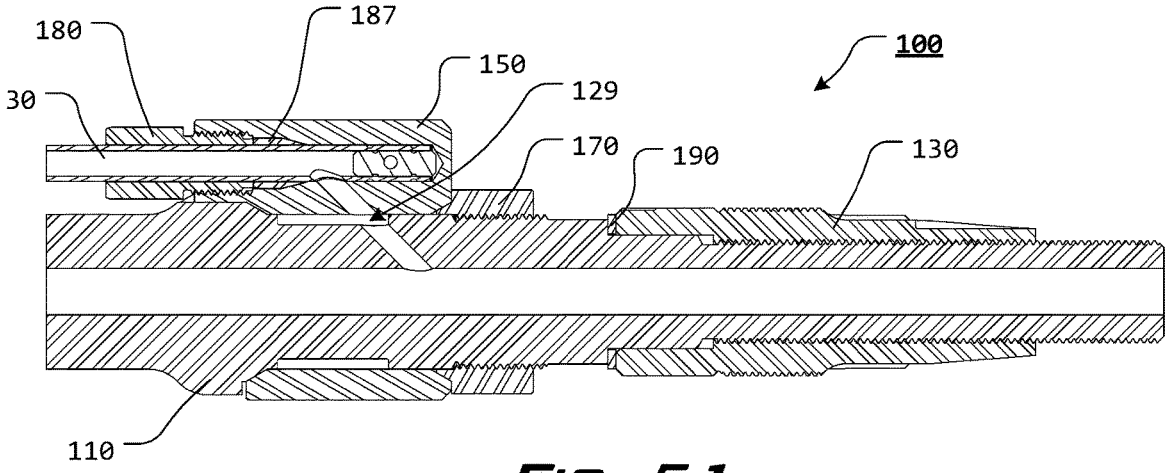
FIG. 51 illustrates a side, cross-sectional view of certain exemplary components of a gas block system and muzzle device system, according to certain aspects of the presently disclosed systems, methods, and/or apparatuses.
Figure 52:
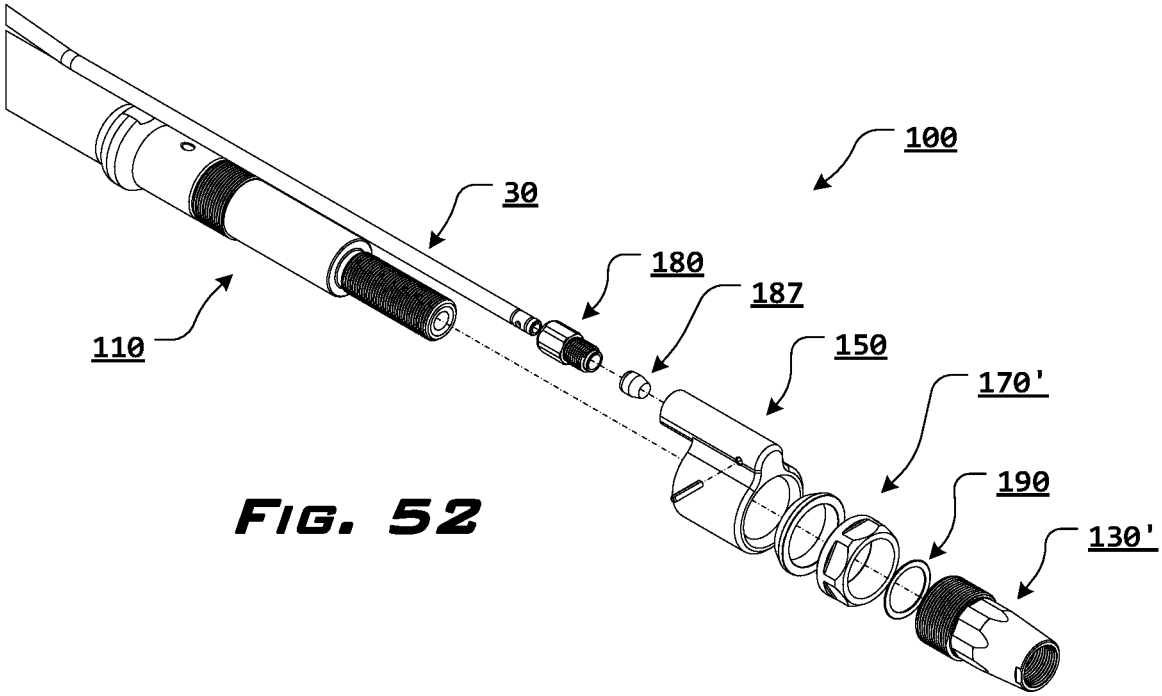
FIG. 52 illustrates a front, perspective, exploded view of certain exemplary components of a gas block system and muzzle device system, according to certain aspects of the presently disclosed systems, methods, and/or apparatuses.
Figure 53:
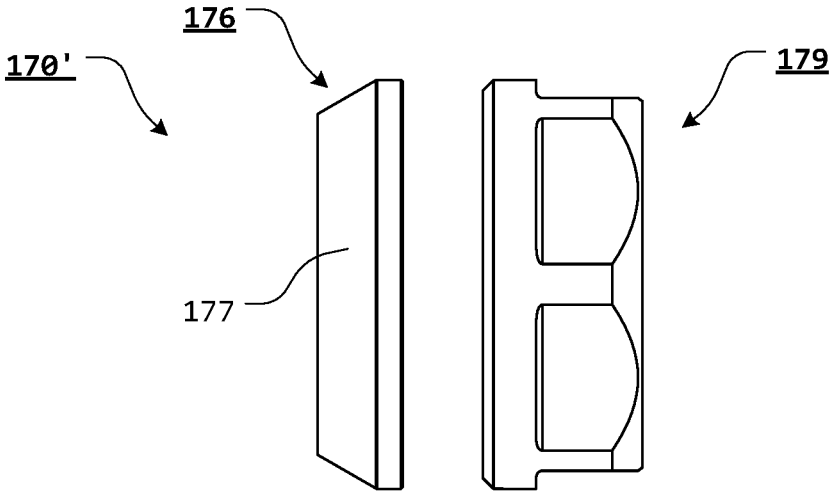
FIG. 53 illustrates a side view of certain exemplary components of an exemplary gas block nut assembly, according to certain aspects of the presently disclosed systems, methods, and/or apparatuses.
Figure 54:
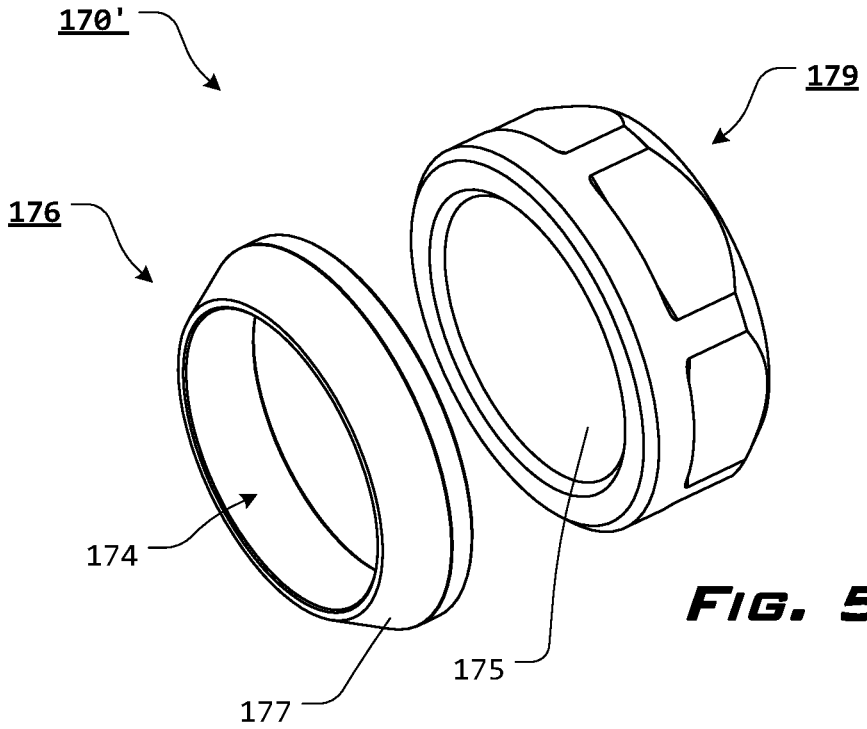
FIG. 54 illustrates a rear, perspective view of certain exemplary components of an exemplary gas block nut assembly, according to certain aspects of the presently disclosed systems, methods, and/or apparatuses.

Thus, when assembled, as illustrated most clearly in FIG. 51, the gas expansion chamber allows gases that have exited the barrel gas port 120 to expand within the gas expansion chamber before traveling through the gas block gas port 161 and into the gas tube 30. Because the gas block 150 is sealed to the barrel 110, it is possible to create a labyrinth under at least a portion of the gas block 150 by removing barrel material. The labyrinth or gas expansion chamber may be an expansion chamber or a series of channels that causes the gas to have to flow further than normal from the barrel gas port 120 to the gas block gas port 161. In this manner, a longer gas system is created on an over barrel suppressor setup. Normally, the over barrel suppressor would dictate how far forward the gas port hole could be positioned.

FIGS. 52-55 illustrate certain elements and/or aspects of various exemplary embodiments of a gas block system 100, according to this invention. As illustrated in FIGS. 52-55, the gas block nut 170 is replaced by a gas block nut assembly 170'. The gas block nut assembly 170' includes a gas block nut 179 and a gas block seal 176. As illustrated, the tapered extension portion 177 that extended from the gas block nut proximal end 171 of the gas block nut 170 is included in the gas block seal 176. The one or more secure notches 178 are replaced by a series of parallel flats formed around a portion of the gas block nut 179.

During assembly, the gas block seal 176 is positioned relative to the gas block 150, such that the tapered extension portion 177 is able to interact with the tapered distal shoulder 158 of the gas block 150. The internally threaded gas block nut aperture portion 175 is adapted to interact with the external threads of the threaded gas block attachment area 119 of the barrel 110 to secure the gas block nut 170 to the barrel 110. In this manner, the gas block nut 179 is threadedly attached to the barrel 110 so as to urge the gas block seal 176 against the gas block 150.

While the presently disclosed systems, methods, and/or apparatuses have been described in conjunction with the exemplary embodiments outlined above, the foregoing description of exemplary embodiments of the present disclosure, as set forth above, are intended to be illustrative, not limiting and the fundamental systems, methods, and/or apparatuses should not be considered to be necessarily so constrained. It is evident that the systems, methods, and/or apparatuses are not limited to the particular variation or variations set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the presently disclosed systems, methods, and/or apparatuses. The upper and lower limits of these smaller ranges may independently be included in the smaller ranges and is also encompassed within the present disclosure, subject to any specifically excluded limit in the stated range. Where the stated range includes one or both of the limits, ranges excluding either or both of those included limits are also included in the present disclosure.

It is to be understood that the phraseology of terminology employed herein is for the purpose of description and not of limitation. Unless defined otherwise, all technical and scientific terms used herein have the same meaning as commonly understood by one of ordinary skill in the art to which the presently disclosed systems, methods, and/or apparatuses belong.

In addition, it is contemplated that any optional feature of the inventive variations described herein may be set forth and claimed independently, or in combination with any one or more of the features described herein. Accordingly, the foregoing description of exemplary embodiments will reveal the general nature of the presently disclosed systems, methods, and/or apparatuses, such that others may, by applying current knowledge, change, vary, modify, and/or adapt these exemplary, non-limiting embodiments for various applications without departing from the spirit and scope of the present disclosure and elements or methods similar or equivalent to those described herein can be used in practicing the present disclosure. Any and all such changes, variations, modifications, and/or adaptations should and are intended to be comprehended within the meaning and range of equivalents of the disclosed exemplary embodiments and may be substituted without departing from the true spirit and scope of the presently disclosed systems, methods, and/or apparatuses.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A gas block system, comprising:

a firearm barrel having a barrel projection and a barrel conical shoulder, wherein a threaded gas block attachment area is formed proximate a gas block attachment area of said barrel, and wherein a barrel gas port is formed within at least a portion of said gas block attachment area of said barrel;

a gas block having a gas block barrel borehole, said gas block barrel borehole having a tapered proximal shoulder and a tapered distal shoulder, said gas block having a gas block gas port; and a gas block nut having a threaded gas block nut aperture portion and a tapered extension portion extending from said gas block nut, wherein said gas block nut is configured to secure said gas block to said barrel such that said tapered proximal shoulder is abutted against said barrel conical shoulder and said tapered distal shoulder is abutted against said tapered extension portion.

2. The gas block system of claim 1, wherein said barrel gas port is formed at a 45° angle relative to a longitudinal axis of said firearm barrel.

3. The gas block system of claim 1, wherein said gas block gas port is formed at a 45° angle relative to a longitudinal axis of said gas block barrel borehole of said gas block.

4. The gas block system of claim 1, wherein said gas block nut is configured to secure said gas block to said barrel by interaction between said threaded gas block attachment area of said barrel and said threaded gas block nut aperture portion of said gas block nut.

5. The gas block system of claim 1, wherein at least a portion of said gas block attachment area of said barrel comprises a gas expansion recess.

6. The gas block system of claim 5, wherein said gas expansion recess comprises a grooved portion, a spiral groove, or a reduced diameter portion of said barrel.

7. The gas block system of claim 5, wherein said gas expansion recess provides fluid communication between said barrel gas port and said gas block gas port.

8. The gas block system of claim 1, wherein said gas block nut is configured to secure said gas block to said barrel such that said barrel borehole is in fluid communication with said gas block gas port.

9. The gas block system of claim 1, wherein a barrel projection notch is formed in a portion of said barrel projection so as to interact with at least a portion of an extension alignment protrusion of said gas block such that if said gas block is installed on said barrel, alignment of at least a portion of said extension alignment protrusion within at least a portion of said barrel projection notch helps to maintain said gas block in a desired rotational position relative to said barrel.

10. The gas block system of claim 1, wherein a gas tube borehole extends into at least a portion of said gas block extension portion, said gas tube borehole having an internally threaded portion, wherein a compression nut is adapted to be at least partially threadedly attached or coupled within at least a portion of said gas tube borehole, via interaction of a compression nut threaded portion of said compression nut and said internally threaded portion of said gas tube borehole to at least partially secure a gas tube within at least a portion of said gas tube borehole.

11. The gas block system of claim 10, wherein a compression fitting is positioned around at least a portion of said gas tube and is maintained within said gas tube borehole by said compression nut.

12. A gas block system, comprising:

a firearm barrel having a barrel projection and a barrel conical shoulder, wherein a threaded gas block attachment area is formed proximate a gas block attachment area of said barrel, and wherein a barrel gas port is formed within at least a portion of said gas block attachment area of said barrel;

a gas block having a gas block barrel borehole, said gas block barrel borehole having a tapered proximal shoulder and a tapered distal shoulder, said gas block having a gas block gas port, wherein a gas tube borehole extends into at least a portion of said gas block extension portion, said gas tube borehole having an internally threaded portion, wherein a compression nut is adapted to be at least partially threadedly attached or coupled within at least a portion of said gas tube borehole, via interaction of a compression nut threaded portion of said compression nut and said internally threaded portion of said gas tube borehole to at least partially secure a gas tube within at least a portion of said gas tube borehole; and a gas block nut having a threaded gas block nut aperture portion and a tapered extension portion extending from said gas block nut, wherein said gas block nut is configured to secure said gas block to said barrel such that said tapered proximal shoulder is abutted against said barrel conical shoulder and said tapered distal shoulder is abutted against said tapered extension portion.

13. The gas block system of claim 12, wherein said gas block nut is configured to secure said gas block to said barrel by interaction between said threaded gas block attachment area of said barrel and said threaded gas block nut aperture portion of said gas block nut.

14. The gas block system of claim 12, wherein at least a portion of said gas block attachment area of said barrel comprises a gas expansion recess.

15. The gas block system of claim 14, wherein said gas expansion recess comprises a grooved portion, a spiral groove, or a reduced diameter portion of said barrel.

16. The gas block system of claim 14, wherein said gas expansion recess provides fluid communication between said barrel gas port and said gas block gas port.

17. The gas block system of claim 12, wherein said gas block nut is configured to secure said gas block to said barrel such that said barrel borehole is in fluid communication with said gas block gas port.

18. The gas block system of claim 12, wherein a barrel projection notch is formed in a portion of said barrel projection so as to interact with at least a portion of an extension alignment protrusion of said gas block such that if said gas block is installed on said barrel, alignment of at least a portion of said extension alignment protrusion within at least a portion of said barrel projection notch helps to maintain said gas block in a desired rotational position relative to said barrel.

19. The gas block system of claim 12, wherein a compression fitting is positioned around at least a portion of said gas tube and is maintained within said gas tube borehole by said compression nut.

20. A gas block system, comprising:

a gas block having a gas block barrel borehole, said gas block having a gas block gas port and a gas block extension portion, wherein a gas tube borehole extends into at least a portion of said gas block extension portion, said gas tube borehole having an internally threaded portion, wherein a compression nut is adapted to be at least partially threadedly attached or coupled within at least a portion of said gas tube borehole, via interaction of a compression nut threaded portion of said compression nut and said internally threaded portion of said gas tube borehole to at least partially secure a gas tube within at least a portion of said gas tube borehole.

* * * * *